US012435720B2

(12) United States Patent
Ausserer

(10) Patent No.: US 12,435,720 B2
(45) Date of Patent: Oct. 7, 2025

(54) ROTARY PISTON COMPRESSOR

(71) Applicant: Florian Karl Ausserer, Dornbirn (AT)

(72) Inventor: Florian Karl Ausserer, Dornbirn (AT)

( * ) Notice: Subject to any disclaimer, the term of this patent is extended or adjusted under 35 U.S.C. 154(b) by 0 days.

(21) Appl. No.: 18/576,167

(22) PCT Filed: Jul. 14, 2021

(86) PCT No.: PCT/AT2021/000015
§ 371 (c)(1),
(2) Date: Jan. 3, 2024

(87) PCT Pub. No.: WO2023/283660
PCT Pub. Date: Jan. 19, 2023

(65) Prior Publication Data
US 2024/0369061 A1 Nov. 7, 2024

(51) Int. Cl.
*F04C 18/22* (2006.01)
*F01C 19/08* (2006.01)
(Continued)

(52) U.S. Cl.
CPC ..... *F04C 18/22* (2013.01); *F01C 19/08* (2013.01); *F04C 27/002* (2013.01);
(Continued)

(58) Field of Classification Search
CPC ..... F04C 18/22; F04C 27/002; F04C 27/005; F04C 23/008; F01C 19/08; F01C 21/108
See application file for complete search history.

(56) References Cited

U.S. PATENT DOCUMENTS 3,064,880 A 11/1962 Felix et al.
3,885,799 A 5/1975 Bibbens
(Continued)

FOREIGN PATENT DOCUMENTS

AU 2376870 A 6/1972
CN 105179235 A 12/2015
(Continued)

OTHER PUBLICATIONS

Tzanakis et al., "Experimental and analytical thermal study of PTFE composite sliding against high carbon steel as a function of the surface roughness, sliding velocity and applied load", SciVerse Science Direct, www.elsevier.com/locate/wear, pp. 154-168, 2013.
(Continued)

*Primary Examiner* — Deming Wan
(74) *Attorney, Agent, or Firm* — Volpe Koenig

(57) ABSTRACT

A rotary piston compressor for compressing gas, in particular carbon dioxide, in which a side wall face of a housing side wall and a respective planar sealing face of a respective housing cover enclose a working chamber and a rotary piston is rotatably mounted in the working chamber on an eccentric. A respective planar-seal receiving channel is formed in the piston bases of the rotary piston and a planar seal is arranged in each of the planar-seal receiving channels. To press the seal surface of the respective planar seal against the respective planar sealing face, lateral-surface openings in the piston lateral surface of the rotary piston have a pressure-transmitting connection to the respective planar-seal receiving channel via pressure leadthrough lines, formed inside the rotary piston and each open into the respective planar-seal receiving channel on a side of the respective planar seal facing away from the seal surface.

17 Claims, 12 Drawing Sheets

(51) Int. Cl.

| | |
|---|---|
| ***F01C 21/10*** | (2006.01) |
| ***F04C 23/00*** | (2006.01) |
| ***F04C 27/00*** | (2006.01) |

(52) U.S. Cl.
CPC ..... *F04C 27/005* (2013.01); *F04C 2210/222* (2013.01); *F04C 2240/20* (2013.01)

(56) References Cited

U.S. PATENT DOCUMENTS

| | | | | |
|---|---|---|---|---|
| 4,105,375 | A | 8/1978 | Schindelhauer | |
| 4,118,157 | A * | 10/1978 | Mayer | F04C 18/22 418/97 |
| 4,150,926 | A | 4/1979 | Eiermann | |
| 4,278,409 | A | 7/1981 | Eiermann | |
| 11,613,995 | B2 * | 3/2023 | Gagnon-Martin | F04C 29/0028 123/200 |
| 2002/0028151 | A1 | 3/2002 | Manner et al. | |

FOREIGN PATENT DOCUMENTS

| | | | |
|---|---|---|---|
| CN | 105179234 | B | 3/2018 |
| DE | 2402558 | A1 | 7/1975 |
| DE | 7729619 | U1 | 10/1983 |
| DE | 2700731 | C2 | 4/1985 |
| DE | 2700522 | C2 | 3/1989 |
| DE | 19850752 | A1 | 5/2000 |
| EP | 1726779 | A1 | 11/2006 |
| JP | S5694886 | A | 7/1981 |
| WO | 2020159394 | A1 | 8/2020 |

OTHER PUBLICATIONS

D.Eiermann-Wankel R&D GmbH/Lindau, "New heat pump compressors Rotary piston heat pump compressors—Wankel system", 5 pages, 1979.
Dr. Peter Göricke, "Wankel Compressor for Heat Pumps", Wankel Journsal Issue 79, 4 pages, Feb. 12, 1976.
Kenichi Yamamoto, "Rotary Engine", MAZDA, www.rotaryrefs.net, 72 pages, 1981.

* cited by examiner

ROTARY PISTON COMPRESSOR

CROSS-REFERENCE TO RELATED APPLICATIONS

This application is a 371 National Phase of PCT/AT2021/000015, filed Jul. 14, 2021, which is incorporated herein by reference as if fully set forth.

TECHNICAL FIELD

The present invention relates to a rotary piston compressor for compressing gas, in particular carbon dioxide, wherein the rotary piston compressor has a working housing and a rotary piston, and the working housing has a housing side wall and two housing covers arranged on oppositely situated sides of the housing side wall, wherein a side wall face of the housing side wall and a respective planar sealing face of the respective housing cover enclose a working chamber arranged in the working housing and the rotary piston is rotatably mounted in the working chamber on an eccentric and the rotary piston compressor has a gas inlet for introducing the gas to be compressed into the working chamber and a gas outlet with a pressure-relief outlet valve for discharging the compressed gas from the working chamber, wherein the rotary piston has two piston bases, which face toward a respective one of the planar sealing faces of the housing covers, and a piston lateral surface which faces toward the side wall face of the housing side wall, and a respective planar-seal receiving channel is formed in the piston bases and a planar seal is arranged in each of the planar-seal receiving channels, wherein the planar seals each have a seal surface for contacting one of the planar sealing faces of the housing covers.

BACKGROUND

Rotary piston compressors per se have been known for quite some time. They are disclosed, for example, in U.S. Pat. Nos. 4,105,375 and 4,118,157.

A rotary piston of a rotary piston compressor of the type in question is disclosed in WO 2020/159394 A1. In the technology disclosed in this document, spring elements are arranged in the planar-seal receiving channels in order to press the planar seals against the respective planar sealing faces of the housing covers of the working housing. In practice, generally these springs generate only small pressing forces and usually serve only for keeping contact with the planar sealing faces. In the prior art, the actual sealing effect is usually generated by a gas pressure acting on the seal, wherein, in the prior art, the gas generating the gas pressure reaches the planar seal via gap sizes between the planar sealing faces of the housing covers and the piston bases.

SUMMARY

Here, an object of the invention is to provide an improvement which ensures a good sealing effect by means of the planar seals in particular even in the event of relatively high gas pressures in the working chamber.

To achieve this object, the invention takes a rotary piston compressor of the type in question as a starting point to provide that, to press the seal surface of the respective planar seal against the respective planar sealing face, in the piston lateral surface of the rotary piston there are formed lateral-surface openings, which have a pressure-transmitting connection to the respective planar-seal receiving channel via pressure leadthrough lines, which are formed inside the rotary piston and each open into the respective planar-seal receiving channel on a side of the respective planar seal that faces away from the seal surface.

Thus, in the case of the invention, it is no longer provided that the gas pressure reaches the planar seal via gap sizes. Instead, the invention provides that selectively provided in the piston lateral surface are lateral-surface openings, which have a direct pressure-transmitting connection to the planar-seal receiving channel via pressure leadthrough lines, which are formed inside the rotary piston. The pressurized gas from the working chamber can act directly on the planar seal in the planar-seal receiving channel through the lateral-surface openings and the pressure leadthrough lines opening into the planar-seal receiving channel, in order to press the planar seal against the respective planar sealing face of the respective housing cover.

This solution according to the invention on the one hand has the advantage that fewer parts are required to press the seal surface of the respective planar seal against the respective planar sealing face of the respective housing cover. Thus, the spring elements in the planar-seal receiving channel that are used in the generic prior art mentioned in the introduction can be omitted completely in the case of the invention. Primarily, however, in the case of the invention the respective gas pressure from the region of the working chamber, into which the respective lateral-surface opening of the rotary piston opens, is available in the corresponding region of the planar-seal receiving channel in order to press the seal surface of the respective planar seal against the respective sealing face of the respective housing cover. As a result, the contact pressure is automatically also matched to the pressures currently present in this region of the working chamber. This has proven successful in particular when particularly high pressures are reached in the working chamber when the gas is being compressed by means of the rotary piston compressor according to the invention.

A particularly preferred field of use for rotary piston compressors according to the invention is compressing carbon dioxide, in order to then be able to use the carbon dioxide as environmentally friendly coolant or heating medium in a cooling or heating circuit. Here, working pressures of at least 80 bar, preferably at least 100 bar, must be reached to compress the carbon dioxide, in order that this carbon dioxide can be used as coolant for coolers, air-conditioning systems or as heating medium for heating systems in buildings, heat pumps and the like. In the case of rotary piston compressors according to the invention, this predominantly involves compressing carbon dioxide. However, rotary piston compressors according to the invention can naturally also be used to compress other gases.

In this connection, gas denotes everything which is gaseous under normal conditions, that is at a temperature of 20° C. and a pressure of 1013.25 mbar. When compressing the respective gas by means of a rotary piston compressor according to the invention, the gas, in particular the carbon dioxide, may well be brought into a transcritical or supercritical state in which it is liquid and gaseous at the same time. However, in the course of the description of the present invention, the term "gas" will be adhered to in the sense of linguistic simplification.

In rotary piston compressors according to the invention, the rotary piston is rotatably mounted on an eccentric. It would therefore also be possible to refer to rotary piston compressors according to the invention as rotary piston compressors according to the conversion principle. The rotary piston could also be referred to as revolving piston or simply as rotor. The rotary piston compressor itself could also be referred to as rotary-piston compressing device. The planar seals could also be referred to as piston base seals.

The pressure leadthrough lines in the rotary piston are preferably tubular. They may be in the form for example of a bore or a sequence of bores that open out into one another inside the rotary piston. However, there are also other options for the design of the pressure leadthrough lines in the rotary piston.

In any case, the lateral-surface openings are preferably formed in the piston lateral surface at a distance from the piston bases.

There are various options for producing and arranging the planar seals in the respective planar-seal receiving channel. A first group of solutions, which can be implemented particularly inexpensively, to this end provides that the planar seals are produced directly in the respective planar-seal receiving channels. Thus, a preferred variant provides, for example, that the planar seals are each injected in the respective planar-seal receiving channel in the form of an injection molded part. In other words, in this variant an injection molding process is used to produce the planar seals directly in the planar-seal receiving channel and thus also arrange them there at the same time. Another variant may however also provide that the planar seals are each printed in the respective planar-seal receiving channel as 3D printed part. In this variant, a printing process is therefore used to produce the respective planar seal directly in the planar-seal receiving channel and thus also arrange it there at the same time. Yet another variant provides that the planar seals are each pressed in the respective planar-seal receiving channel in the form of a molded pressed part.

As a deviation from this, however, it is also possible to first of all produce the planar seal and then arrange it in the planar-seal receiving channel after it has been produced. It is thus also possible that the planar seals are each prefabricated in the form of an insert part and inserted as such in the respective planar-seal receiving channel.

Preferred variants of the invention provide that the pressure leadthrough lines are each covered by a cap in the region of their opening into the respective planar-seal receiving channel. The use of corresponding caps to cover the opening of the pressure leadthrough lines into the respective planar-seal receiving channel is particularly favorable when the planar seals are formed, for example, directly in the planar-seal receiving channel by injection molding or 3D printing. The caps may prevent the opening of the pressure leadthrough lines being accidentally closed during the production process for the planar seals. Of course, however, corresponding caps can also be used when the planar seal is prefabricated in each case as insert part and inserted as such in the respective planar-seal receiving channel. It should be noted here that the wording "covering said opening by means of the cap" does not mean that the caps close the respective openings of the pressure leadthrough lines in pressure-tight fashion. The caps are only placed on. With a corresponding gas pressure in the pressure leadthrough lines, the gas can by all means penetrate past the caps into the planar-seal receiving channel, in order to press the seal surface of the planar seals against the respective planar sealing face of the respective housing cover. In other variants, however, the caps can also be omitted.

In the sense of the lowest possible number of parts, preferred variants of the invention provide that the planar seals are intrinsically each formed in one piece in one of the planar-seal receiving channels in one of the piston bases. In other words, in such variants there is then correspondingly always only exactly one planar seal in a planar-seal receiving channel. The planar seal of this planar-seal receiving channel is then correspondingly intrinsically formed in one piece.

In rotary piston compressors according to the invention, it is expediently provided that the side wall face of the housing side wall has a completely or at least partially trochoidal form when viewed in a sectional plane parallel to the planar sealing faces of the housing covers.

The rotary piston preferably has two or more corner regions. Expediently, it is provided here that a respective radial seal for sealing the rotary piston with respect to the side wall face of the housing side wall is arranged in the corner regions. It is in turn particularly preferably provided that the piston bases are each delimited by a boundary line in the region between two respective corner regions of the rotary piston, wherein the boundary lines are each in the form of an envelope of an array of trochoid curves.

In order to press the respective radial seal against the side wall face of the housing side wall, there are various options which can also be combined with one another. Thus, in rotary piston compressors according to the invention, it may for example be provided that a respective elastic element, pointing toward the rotary piston, for pressing the respective radial seal against the side wall face of the housing side wall is integrally molded in one piece on the radial seals. In preferred variants, as an alternative or else in addition to this it is provided that the planar seal is used to press the respective radial seal against the side wall face of the housing side wall. Such variants can then provide that the planar seals each have contact faces for pressing the respective radial seal against the side wall face of the housing side wall. These contact faces of the planar seals may each be in the form of slanted faces and act on corresponding slanted faces of the respective radial seal.

As depicted below in the description of the figures, when gas is compressed by means of rotary piston compressors in the working chamber, different sub-volumes are produced, which are separated from one another by the rotary piston and its corner regions and in which different gas pressures also prevail during operation, and the size of these sub-volumes continuously changes during operation. There are respective sub-volumes of the working chamber into which, depending on the current position of the rotary piston, gas is sucked in, while on another side of the rotary piston the gas is respectively compressed at this point in time. This results in both low-pressure and high-pressure sides on different sides of the rotary piston at the same time. In order to prevent gas flowing through the lateral-surface openings, the pressure leadthrough lines and the planar-seal receiving channels from the respective current high-pressure side into a respective current low pressure side, preferred variants of the invention provide that, in the corner regions of the rotary piston, the planar seals are each sealed on their side facing away from the respective seal surface with respect to the planar-seal receiving channel receiving them. In order to bring about this sealing, it is possible to provide for example that the planar seals have sealing projections, which are arranged in corresponding sealing-projection receptacles in the planar-seal receiving channel, on the side facing away from the seal surface. Thus, regions of the planar-seal receiving channel between two respective adjacent corner regions of the rotary piston can be sealed with respect to respective adjacent regions of the planar-seal receiving channel.

As is known per se for rotary piston compressors, rotary piston compressors according to the invention may also be designed with different transmission ratios. The transmission ratio denotes the ratio of the number of trochoid arcs present for forming the side wall face of the housing side wall to the number of corners of the rotary piston. In rotary piston compressors according to the invention, the transmission ratio is expediently 1:2 or 2:3 or 7:6.

In rotary piston compressors according to the invention, the gas inlet and/or the gas outlet may pass through the housing wall. As an alternative, however, it is also possible that the gas inlet and/or the gas outlet pass(es) through the eccentric. Mixed forms of this are also possible.

The planar seals and/or the possibly present radial seals expediently consist of a polymer or a polymer comprising a dry lubricant and/or comprising reinforcing fibers. Polymers that can be used are for example polyetheretherketone, polyamideimide, polyoxymethylene, polyketone, polyamide or polyethyleneterephthalate. Dry lubricants that can be used are for example polytetrafluoroethylene or molybdenum disulfide. Reinforcing fibers considered are for example glass fibers or carbon fibers.

In preferred variants, the housing side wall and the housing covers each have a main body made of an aluminum alloy or a cast iron. A coating is preferably applied to this main body to form the side wall face of the housing side wall and the planar sealing faces of the housing cover. The coating may be a nickel-phosphorus layer, an aluminum-oxide layer or a dry-film lubricating layer. A combination of at least two of these layers is also possible. These coatings can be applied directly to the main body. However, it is also possible for there to be an open-pore adhesive layer, to which the coating is then applied, on the main body. In the case of a main body made of an aluminum alloy, the adhesive layer may be for example an open-pore aluminum-oxide layer, such as anodized aluminum or uncompressed hard anodized aluminum. Another variant of a substrate or adhesive layer consists in an open-pore, plasma-chemically oxidized aluminum layer. In the case of main bodies made of cast iron, the substrate or adhesive layers may be formed for example by phosphating or sandblasting.

Provided it does not distort the meaning, the terms "one" or "a" used here are to be understood in the sense of "at least one".

BRIEF DESCRIPTION OF THE DRAWINGS

Further features and details of preferred configurations of the invention are explained by way of example in the following description of the figures on the basis of various embodiment variants of the invention. In the figures.

DETAILED DESCRIPTION

Figure 1:
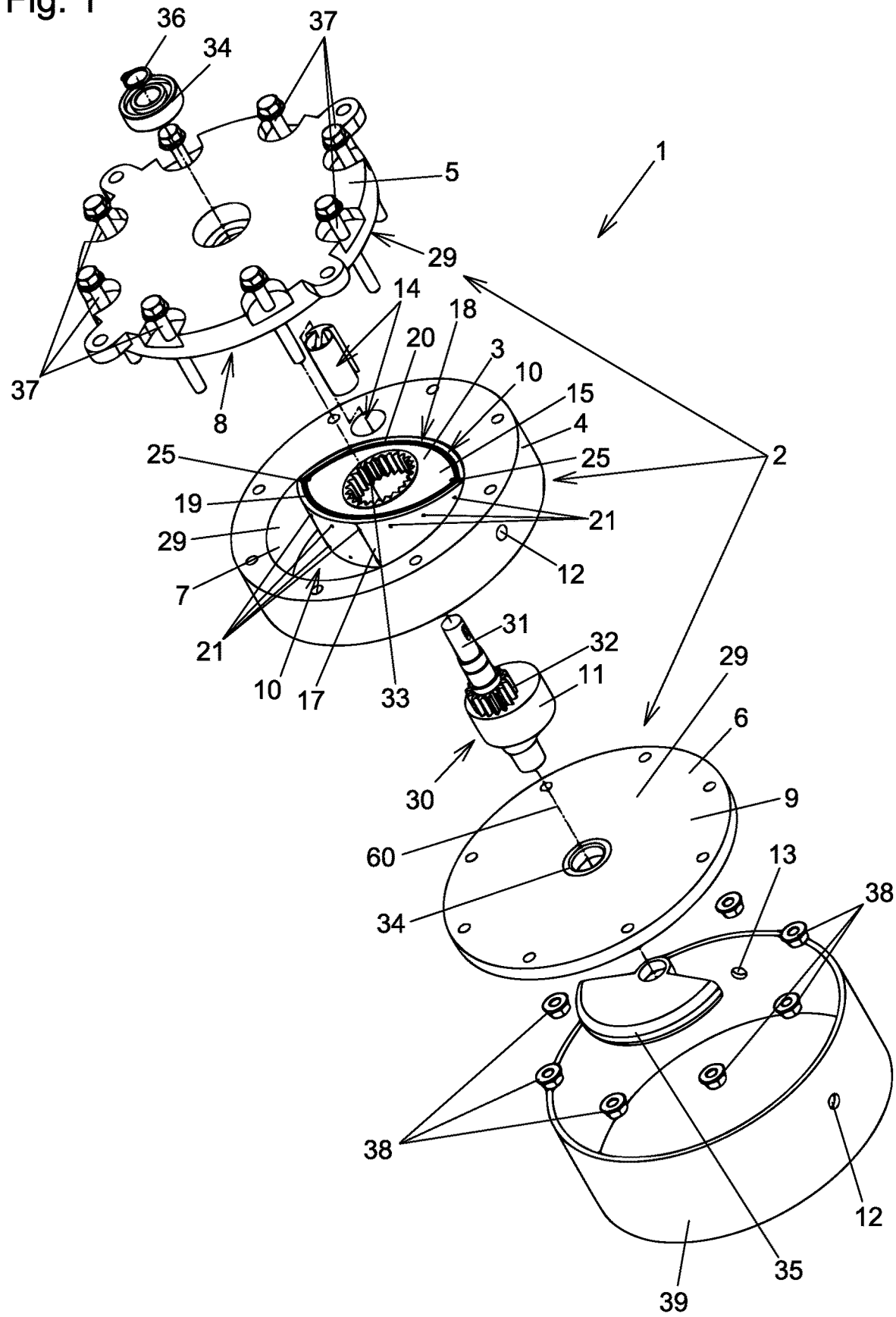
FIGS. 1 to 21 show illustrations relating to a rotary piston compressor according to the invention with a transmission ratio of 1:2, and modifications thereof.

FIG. 1 shows an exploded illustration of the first exemplary embodiment of a rotary piston compressor 1 according to the invention. It is a rotary piston compressor 1 with a transmission ratio of 1:2. The rotary piston compressor 1 comprises a working housing 2 and a rotary piston 3. The working housing 2 in turn comprises a housing side wall 4 and housing covers 5 and 6 arranged on mutually opposite sides of the housing wall 4. In this exemplary embodiment, these components of the working housing 2 are connected to one another by the screws 37 and the nuts 38. However, this does not necessarily have to be the case, of course; other types of connection are also conceivable.

Figure 2:
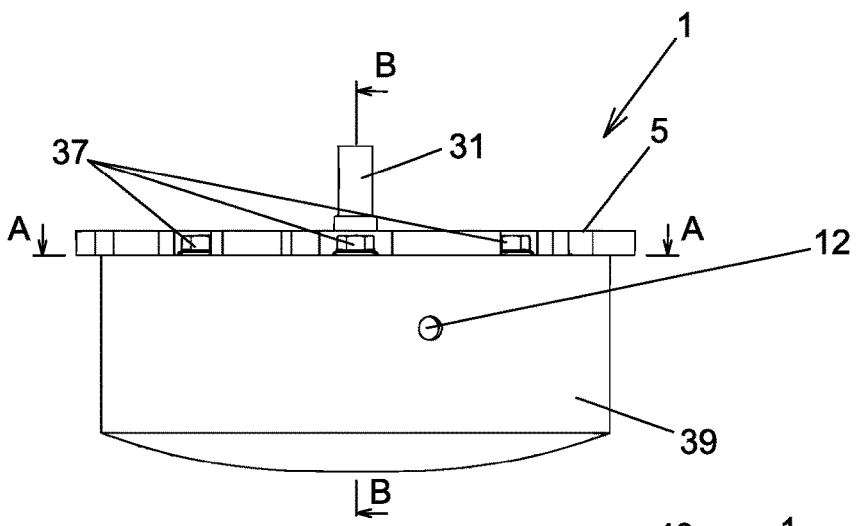

The side wall face 7 of the housing side wall 4 and the two planar sealing faces 8 and 9 of the respective housing covers 5 and 6 enclose the working chamber 10 arranged in the working housing 2. The rotary piston 3 is rotatably mounted on the eccentric 11 in the working chamber 10. In this first exemplary embodiment, the eccentric 11 sits on a drive shaft 30 for conjoint rotation. As can be seen in FIG. 2, this drive shaft 30 ends in a connecting journal 31, which protrudes from the rotary piston compressor 1 in the assembled state and to which a motor for rotating the drive shaft 30 and thus also the eccentric about the axis of rotation 60 can be connected. In this exemplary embodiment, the eccentric 11 is thus connected to the drive shaft 30 and also the connecting journal 31 for conjoint rotation, so that rotation of the drive shaft 30 about the axis of rotation 60 also automatically results in a corresponding conjoint rotation of the eccentric 11.

In this exemplary embodiment, an external toothing 32 is also connected to the drive shaft 30 for conjoint rotation. This external toothing 32 engages in an internal toothing 33, which is connected to the rotary piston 3 for conjoint rotation. This threaded engagement causes the rotary piston 3 to conjointly rotate in the working chamber 10 when there is corresponding rotation of the connecting journal 31 or drive shaft 33. The rotary piston 3 is rotatably mounted on the eccentric 11 in the working chamber 10.

The drive shaft 30 is rotatably mounted in the working housing 2 via the bearings 34 and the securing ring 36. The bearings 34 may be both ball bearings and plain bearings or the like. In the exemplary embodiment shown, the bearing 34 in the housing cover 5 is a ball bearing and the bearing 34 in the housing cover 6 is a plain bearing. However, this does not have to be the case, of course, and can also be configured differently.

A balance weight 35, which compensates the unbalance resulting from the eccentricity of the rotary piston 3, is mounted on the drive shaft 30 for conjoint rotation below the housing cover 6 and thus outside the working housing 2 In the exemplary embodiment shown, the working housing 2 is surrounded by an outer shell 39 of the rotary piston compressor 1. However, this also does not necessarily have to be the case, of course.

In the case of the rotary piston compressor 1 of this first exemplary embodiment, a gas inlet 12 for introducing the gas to be compressed into the working chamber 10 and also a gas outlet 13 with a pressure-relief outlet valve 14 for discharging the compressed gas from the working chamber 10. As explained below, this can be seen particularly clearly in FIGS. 3 to 6.

The rotary piston 3 has two piston bases 15 and 16 which face one of the planar sealing faces 8 and 9, respectively, of the housing covers 5 and 6 and a piston lateral surface 17 facing toward the side wall face 7 of the housing side wall 4. A respective planar-seal receiving channel 18 is in the piston bases 15 and 16. A planar seal 19 is arranged in each of these planar-seal receiving channels 18, wherein the planar seals 19 each have a seal surface 20 for bearing against one of the planar sealing faces 8 and 9 of the housing covers 5 and 6. This is explained in more detail on the basis of the subsequent figures. According to the invention, what is in any case also provided in the case of the rotary piston compressor 1 of this first exemplary embodiment is that, to press the seal surface 20 of the respective planar seal 19 against the respective planar sealing face 8, 9, in the piston lateral surface 17 of the rotary piston 3 there are formed lateral-surface openings 21, which have a pressure-transmitting connection to the respective planar-seal receiving channel 18 via pressure leadthrough lines 22, which are formed inside the rotary piston 3 and each open into the respective planar-seal receiving channel 18 on a side of the respective planar seal 19 that faces away from the seal surface 20. This is explained below, in particular on the basis of FIGS. 7, 8 and 11-13.

Figure 7:
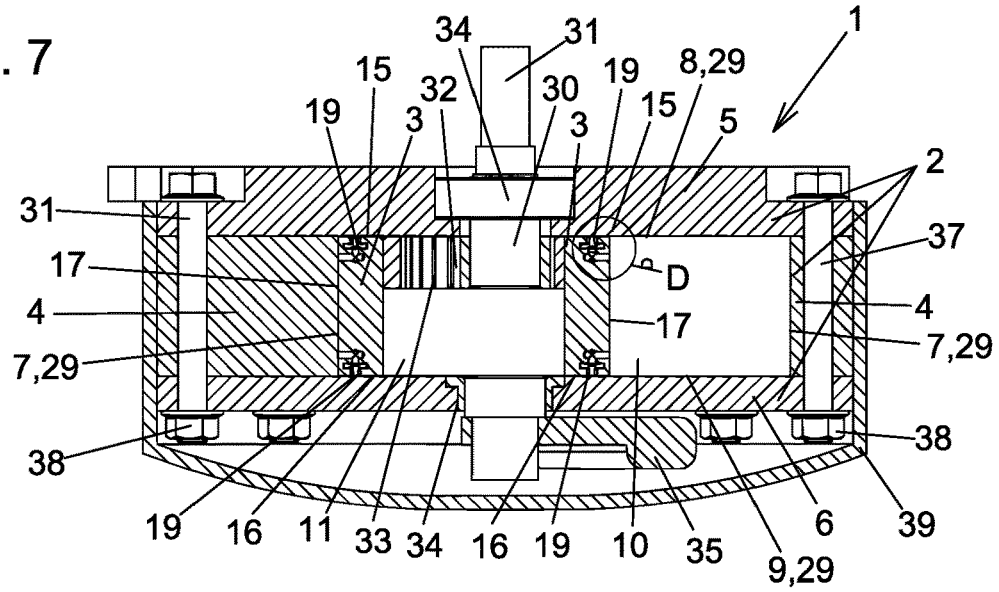
Figure 9:
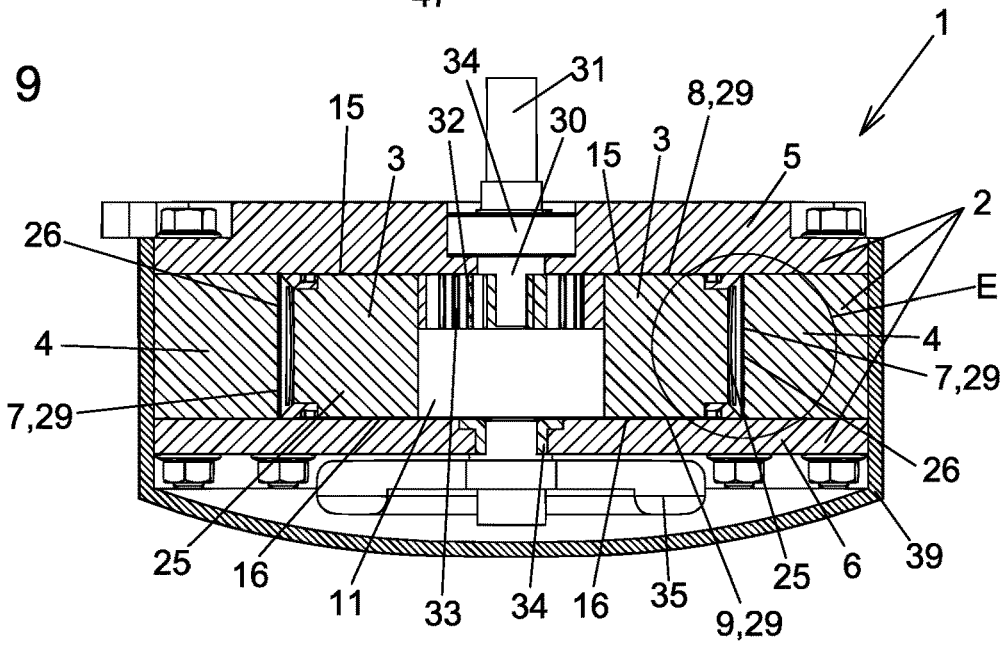

For the sake of completeness, it should be noted that the internal toothing 33 in the rotary piston 3 of this first embodiment is illustrated in FIGS. 1, 7 and 9, but is not shown in FIGS. 3 to 6, 11, 14 and 18. The fact that the internal toothing 33 is not illustrated in the stated Figures is a simplification purely for the drawing and does not mean that the internal toothing 33 is actually missing.

FIG. 2 is a side view of the assembled rotary piston compressor 1 of this first exemplary embodiment, with the sectional plane A-A being depicted. FIGS. 3 to 6 each show somewhat simplified sectional drawings relating to this sectional plane A-A, different positions of the rotary piston 3 during one revolution about the drive shaft 30 or its longitudinal axis being illustrated in order to explain the mode of operation of the rotary piston compressor 1. The arrow 42 shows the direction of rotation of the rotary piston 3 in the working chamber 10.

It can be seen in FIGS. 3 to 6 that, in this exemplary embodiment, the side wall face 7 of the housing side wall 4 has a completely trochoidal form when viewed in a sectional plane parallel to the planar sealing faces 8, 9 of the housing covers 5, 6. The rotary piston 3 has two corner regions 25. In these corner regions 25 there is a respective radial seal 26 for sealing the rotary piston 3 with respect to the side wall face 7 of the housing side wall 4. The piston bases 15 and 16 are each delimited by a boundary line 27, which is an envelope of an array of trochoid curves, in the region between two respective ones of the corner regions 25 of the rotary piston 3. The rotary piston 3 subdivides the working chamber 10 into a low-pressure side 40 and a high-pressure side 41 by means of its corner regions 25 and the radial seals 26 arranged there. On the low-pressure side 40, gas is introduced or sucked into the working chamber 10 through the gas inlet 12 as the rotary piston 3 rotates. On the high-pressure side 41, the volume of which decreases with increasing rotation of the rotary piston 3, the previously sucked-in gas is compressed, with the result that the gas pressure continuously rises on the high-pressure side 41 as the rotary piston 3 rotates. If the desired gas pressure or the desired compression of the gas on the high-pressure side 41 is reached, the pressure-relief outlet valve 14 opens, with the result that the compressed gas can flow out of or be discharged from the working chamber 10 through the gas outlet 13. Correspondingly setting or selecting a corresponding pressure-relief outlet valve makes it possible to set the extent to which the gas is compressed by the rotary piston compressor 1 before it flows away through the gas outlet 13. Briefly, it is thus possible to define or set the degree to which the gas is compressed in the rotary piston compressor 1.

FIGS. 3 to 6 show by way of example four different positions of the rotary piston 3 during one revolution and thus during the compression process depicted. This mode of operation of rotary piston compressors 1 is known per se and does not need to be explained further. The arrows 43 in FIGS. 3 to 6 depict the gas which flows in or is sucked in through the gas inlet 12 and is yet to be compressed. The arrows 44 depict the already compressed gas that flows out through the gas outlet 13.

Figure 8:
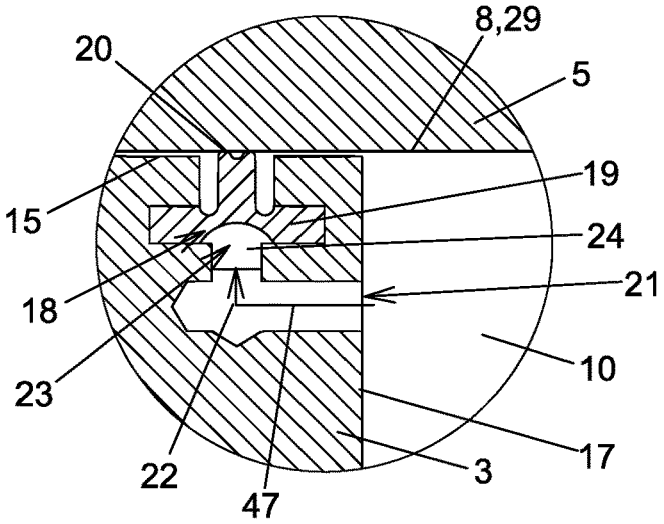

FIG. 7 now shows a vertical section through the rotary piston compressor 1 of this first exemplary embodiment along a sectional plane BB, which is indicated in FIG. 2 and is vertical, or extends along the axis of rotation 60 of the drive shaft 30 and in the case of which the lateral-surface openings 21 and pressure leadthrough lines 22 essential to the invention are sectioned. FIG. 8 shows an enlargement of the region D from FIG. 7. In these two sectional illustrations, it can be clearly seen that a respective planar-seal receiving channel 18 is formed in each of the two piston bases 15 and 16, wherein there is a planar seal 19 in each of the planar-seal receiving channels 18. The planar seals 19 each have a seal surface 20, with which they rest against one of the planar sealing faces 8 and 9 of the housing covers 5 and 6, respectively, for sealing purposes. FIG. 8 illustrates in detail that in the piston lateral surface 17 of the rotary piston 3 there are formed lateral-surface openings 21, which have a pressure-transmitting connection to the planar-seal receiving channel 18 via pressure leadthrough lines 22, which are formed inside the rotary piston 3 and each open into the respective planar-seal receiving channel 18 on a side of the respective planar seal 19 that faces away from the seal surface 20. In preferred embodiments, like the one shown here, the pressure leadthrough lines 22 are tubular. Here, specifically, they are in the form of a sequence of bores inside the rotary piston that open out into one another. The lateral-surface openings 21 are arranged in the piston lateral surface 17 at a distance from the piston bases 15 and 16. The arrow 47 illustrating the direction in which pressure is applied depicts how the correspondingly pressurized gas in the working chamber 10 applies pressure to the planar seal 19 through the lateral-surface opening 21 and the pressure leadthrough line 19 on the side situated opposite the seal surface 20, whereby the seal surface 20 is pressed against the respective planar sealing face 8 and 9, respectively. This has the effect that the gas pressure in the working chamber 10 is used to press the seal surface 20 of the planar seal 19 against the corresponding planar sealing face 8 and 9. This makes it possible to achieve a very good seal even in the event of very high pressures in the working chamber 10. In the exemplary embodiment shown according to FIG. 8, there is a cap 24, which covers the pressure leadthrough line 22, in the region of the opening 23 of the pressure leadthrough line 22 in the planar-seal receiving channel 18. This cap 24 is designed such that it does not obstruct the transfer of pressure. When there is a corresponding buildup of pressure the pressure leadthrough line 22, gas can flow, expediently past the cap 24, into the planar-seal receiving channel 18 on that side of the planar seal 19 that is situated opposite the seal surface 20, in order to correspondingly press the seal surface 20 of the planar seal 19 against the respective planar sealing face 8 and 9.

As explained in the introduction, the cap 24 can in principle also be omitted. If, however, the planar seal 19 is, as realized here, injected in the planar-seal receiving channel 18 in the form of an injection molded part or printed in the respective planar-seal receiving channel 18 in the form of a 3D printed part, the cap 24 prevents inadvertent closing of the respective opening 23 when the planar seal 19 is being formed or produced.

Figure 3:
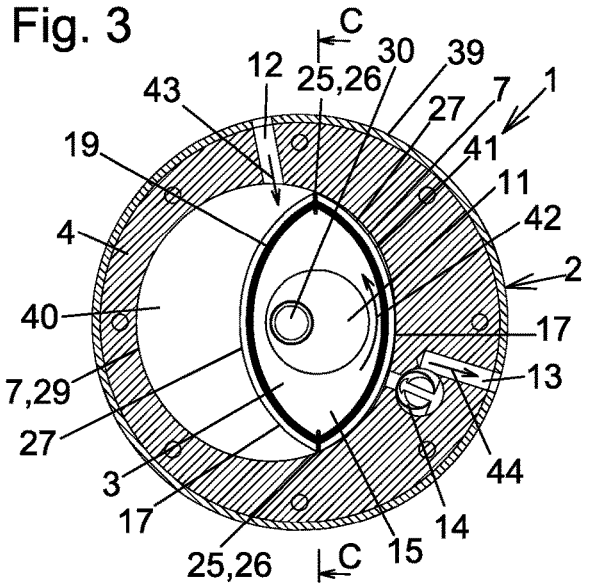
Figure 4:
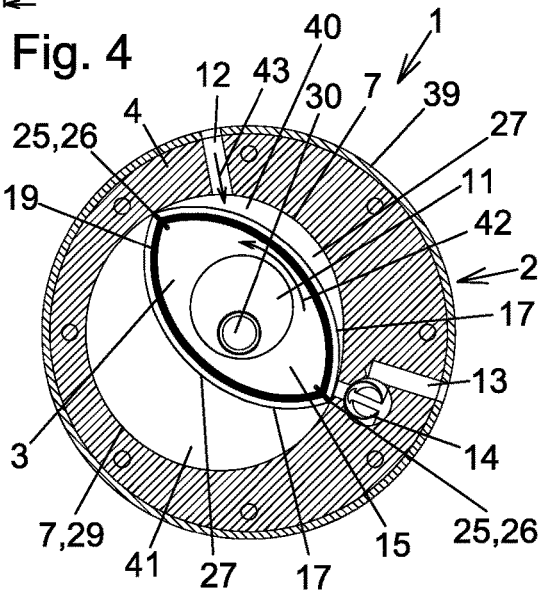
Figure 5:
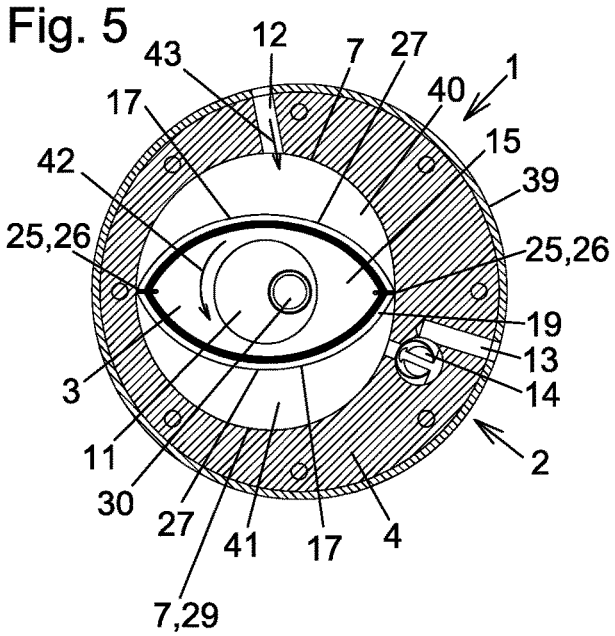
Figure 6:
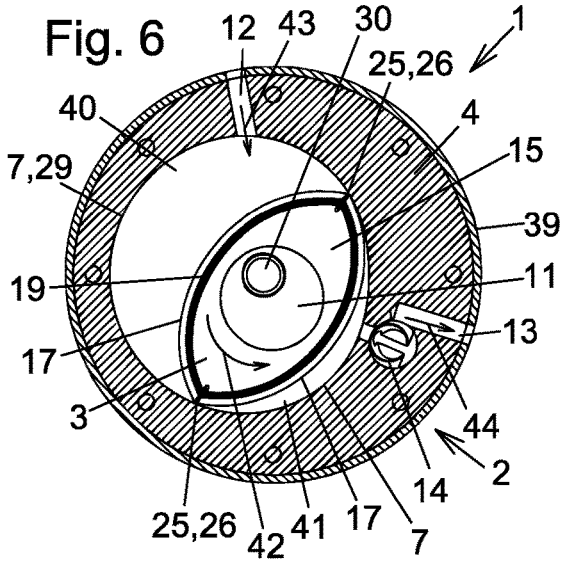
Figure 10:
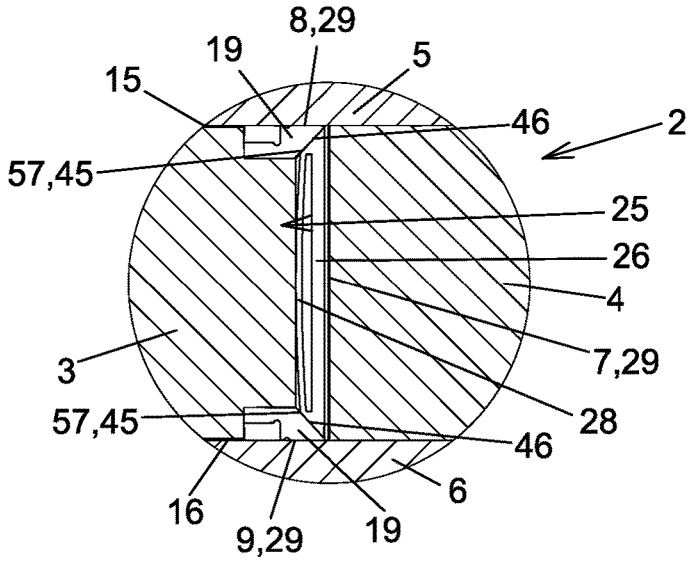

FIG. 9 shows a section through the rotary piston compressor 1 of this first exemplary embodiment along the sectional plane C-C, which is depicted in FIG. 3 and extends through the corner regions 25 and the radial seals 26 of the rotary piston 3 that are arranged there. FIG. 10 shows an enlargement of the region E from FIG. 9.

Figure 14:
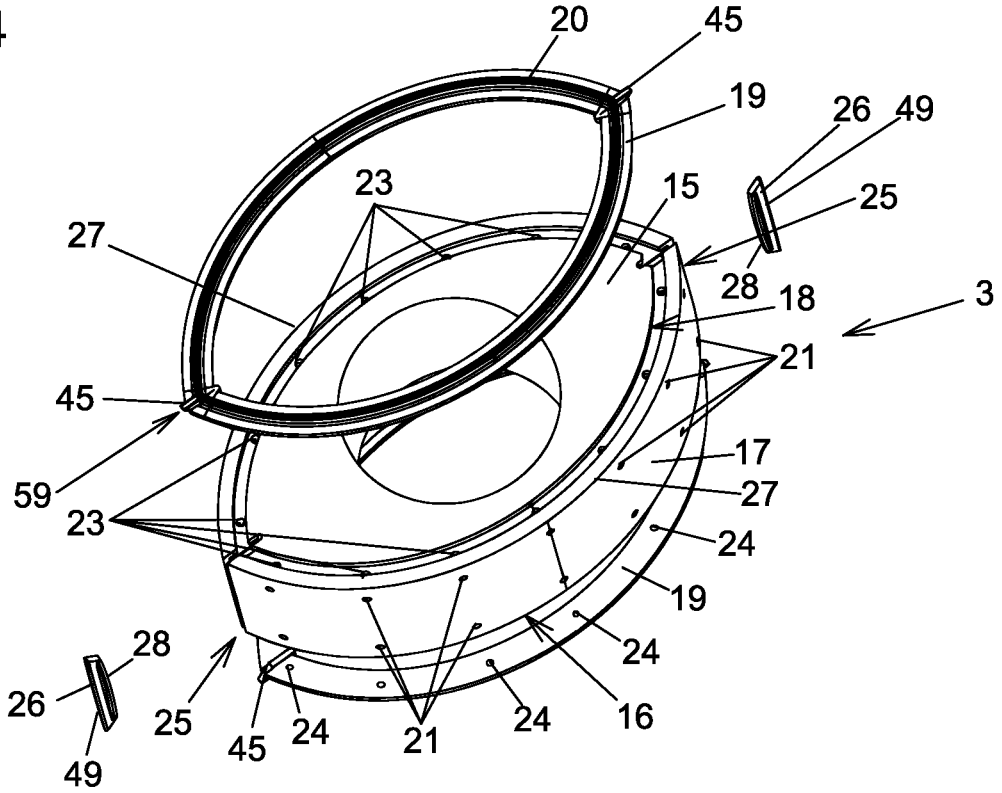
Figure 16:
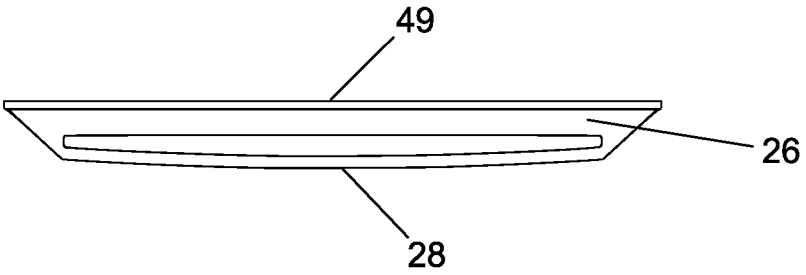
Figure 17:
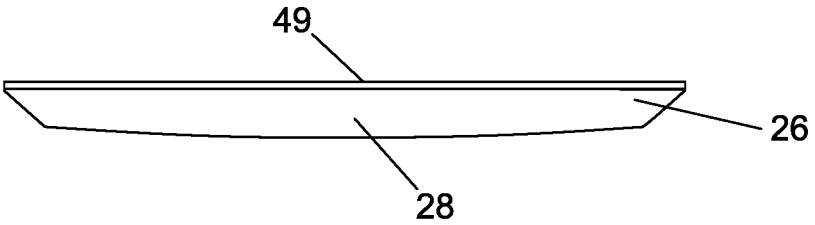

What can be seen here first of all is how the radial seals 26 bear against the side wall faces 7 of the housing side wall 4 to seal the rotary piston 3. In order to generate the contact pressure necessary for the sealing, here two measures are taken. Firstly, an elastic element 28 facing the rotary piston 3 is integrally molded on the radial seal 26 and presses the radial seal 26 against the side wall face 7 of the housing side wall 4. Secondly, however, the contact faces 57 of the planar seals 19 also press the respective radial seal 26 against the side wall face 7. In FIGS. 10, 14 and 16, the elastic element 28 integrally molded on the radial seal 26 on the radial seal surface 49 is formed in the manner of an exposed leaf spring. FIG. 17 shows a variant of this in which the elastic element 28 is in the form of a corresponding bulge on that side of the radial seal 26 that is situated opposite the radial seal surface 49.

Returning to FIG. 10, it should be noted that the contact faces 57 of the planar seal 19 for pressing the respective radial seal 26 against the side wall face 7 are expediently in the form of slanted faces 45. As can be clearly seen in FIG. 10, the radial seal 26 expediently has corresponding slanted faces 46, on which the contact faces 57 or inclined faces 45 of the respective planar seal 19 act.

Figure 11:
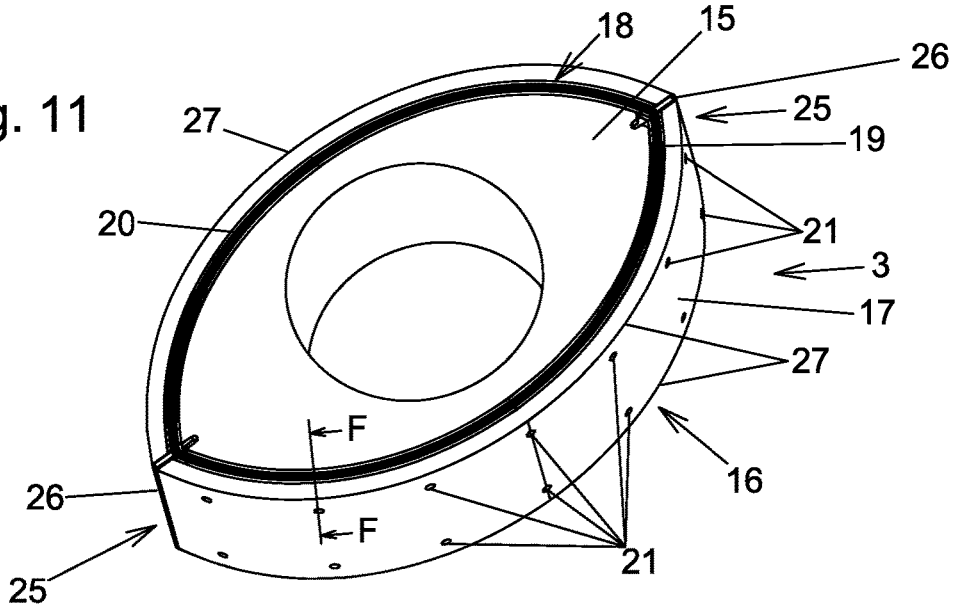
Figure 12:
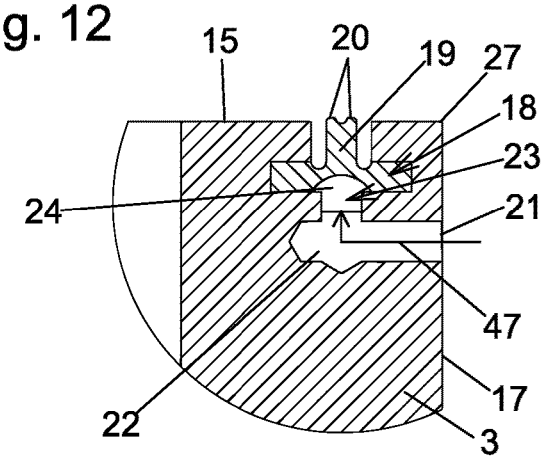

FIG. 11 shows a perspective view of the rotary piston 3, with the planar seal 19 arranged on the piston base 15 in the planar-seal receiving channel 18. This is likewise correspondingly formed on the oppositely situated piston base 16, which cannot be seen in FIG. 11. Also clearly visible here are the boundary lines 27 of the piston bases 15 and 16, which are each in the form of an envelope of an array of trochoid curves between the corner regions 25 of the rotary piston 3. The lateral-surface openings 21 provided according to the invention are arranged in the piston lateral surface 17. In section F-F, which is illustrated in FIG. 12, the pressure-transmitting connection according to the invention between the lateral-surface openings 21 and the planar-seal receiving channel 18 via one of the pressure leadthrough lines 22 is again illustrated. Apart from the housing cover 5 that is missing here in FIG. 12, the illustration according to FIG. 12 corresponds to the already discussed illustration according to FIG. 8, and therefore reference can substantially be made to what was said above. It should again be noted here at this juncture, however, that in this exemplary embodiment the planar seal 19 is injected in the respective planar-seal receiving channel 18 in the form of an injection molded part in each case. Similarly, the planar seal 19, as already set out, could of course be in the form of a 3D printed part or molded pressed part in the planar-seal receiving channel 18.

Figure 13:
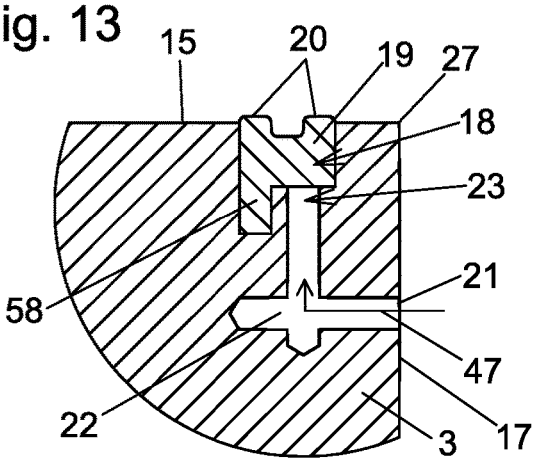

FIG. 13 shows an alternative to this by way of example. Here, the planar seal 19 is prefabricated in the form of an insert part and inserted as such in the respective planar-seal receiving channel 18. The projections 58 of this planar seal 19 ensures corresponding guidance, when gas pressure is applied to the planar seal 19 according to the invention in the pressure application direction 47 through the lateral-surface opening 21, the pressure leadthrough line 22 and the planar-seal receiving channel 18 on the side facing away from the seal surface 20, in order to press the seal surface 20 of the planar seal 19 against the planar sealing faces 8 and 9, not illustrated in FIG. 13, of the housing covers 5 and 6, respectively. In the alternative according to FIG. 13, no caps 24 for covering the openings 23 are provided. It would also be possible, however, of course to also use corresponding caps 24 to cover the openings 23 in this variant according to FIG. 13.

FIG. 14 shows an exploded illustration of the rotary piston 3, in which the planar seals 19 and the radial seals 26 are illustrated as detached from the rotary piston 3. It can also be clearly seen in FIG. 14 that the planar seals 19, which are arranged in one of the planar-seal receiving channels 18, are preferably intrinsically formed in one piece. In FIG. 14, it is also possible again to see the openings 23 of the pressure leadthrough lines 22 in the planar-seal receiving channel 18.

Figure 15:
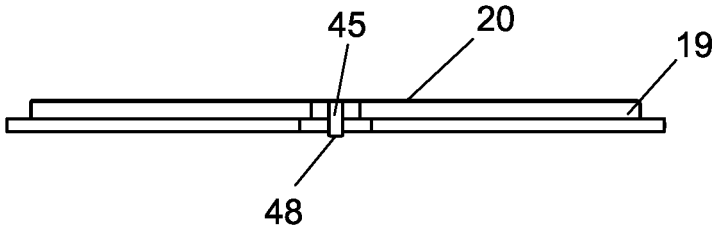
Figure 18:
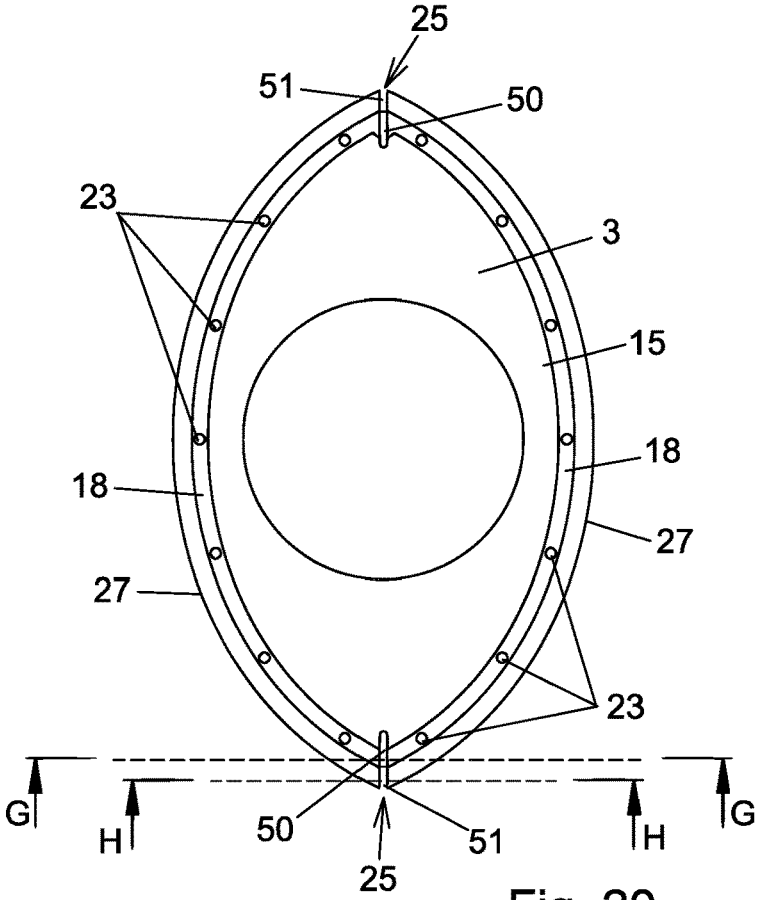
Figure 19:
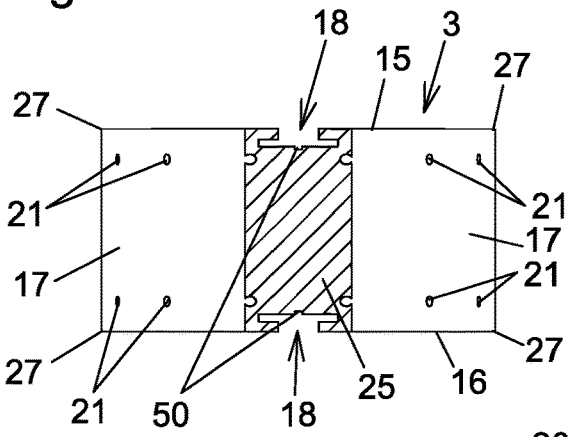
Figure 20:
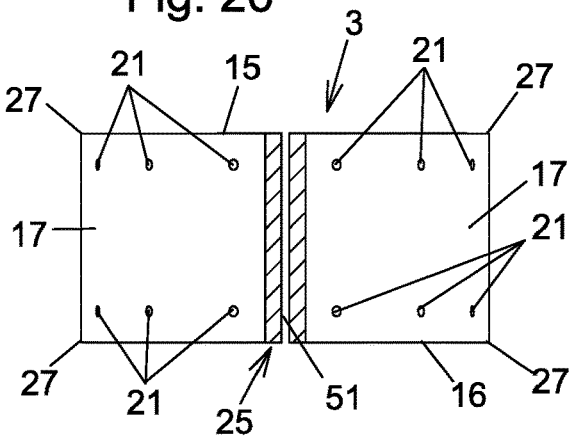
Figure 21:
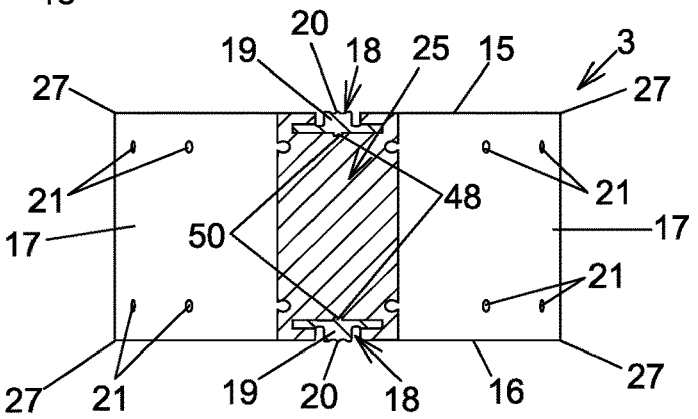

FIG. 15 is a side view of one of the planar seals 19 from the direction 59 depicted in FIG. 14. Here, underneath the already discussed slanted face 45 of the sealing projection 48, it is possible to see the planar seal 19, which, as will be explained again later on, serves to seal the planar seal 19 in the respective corner regions 25 of the rotary piston 3 on its side facing away from the respective seal surface 20 with respect to the planar-seal receiving channel 18 that receives it. This type of sealing at this point could of course also be effected differently, for example by an adhesive bond, clipping on or the like. This sealing, however, is particularly preferably effected by arranging the mentioned sealing projection 48 in a sealing-projection receiving groove 50, which is in the respective corner region 25 in the form of a depression in the planar-seal receiving channel 18. In this respect, reference is made to FIGS. 18 to 21. FIG. 18 shows a plan view of one of the piston bases 15 of the rotary piston 3 and the sectional lines or sectional planes GG and HH. The sectional line GG is in the region of the sealing-projection receiving groove 50, as can be seen in FIG. 19. In the sectional plane HH, the rotary piston 3 is sectioned in the region of the radial-seal receiving channel 51, in which the radial seal 26 is inserted. FIG. 21 shows the same section as FIG. 19, although in FIG. 19 a respective planar seal 19 is arranged in the respective planar-seal receiving channel 18. What can also be seen here is how the sealing projection 48 of the respective planar seal 19 is arranged in the respective sealing-projection receiving groove 50, in order to achieve the desired sealing effect.

As already explained in the introduction, the planar seals 19 and also the radial seals 28 expediently consist of a polymer, preferably comprising a dry lubricant and/or reinforcing fibers. The housing side wall 4 and the housing covers 5 and 6 expediently have a main body made of an aluminum alloy or a cast iron. A coating 29 is expediently formed on the respective main body to form the side wall faces 7 of the housing side wall 4 and of the planar sealing faces 8 and 9 of the housing covers 5 and 6. This is also preferably the case in this first exemplary embodiment. In this respect, reference is made to the explanations already set out in the introduction as regards the details and preferred embodiment variants of such a coating 29.

Figure 22:
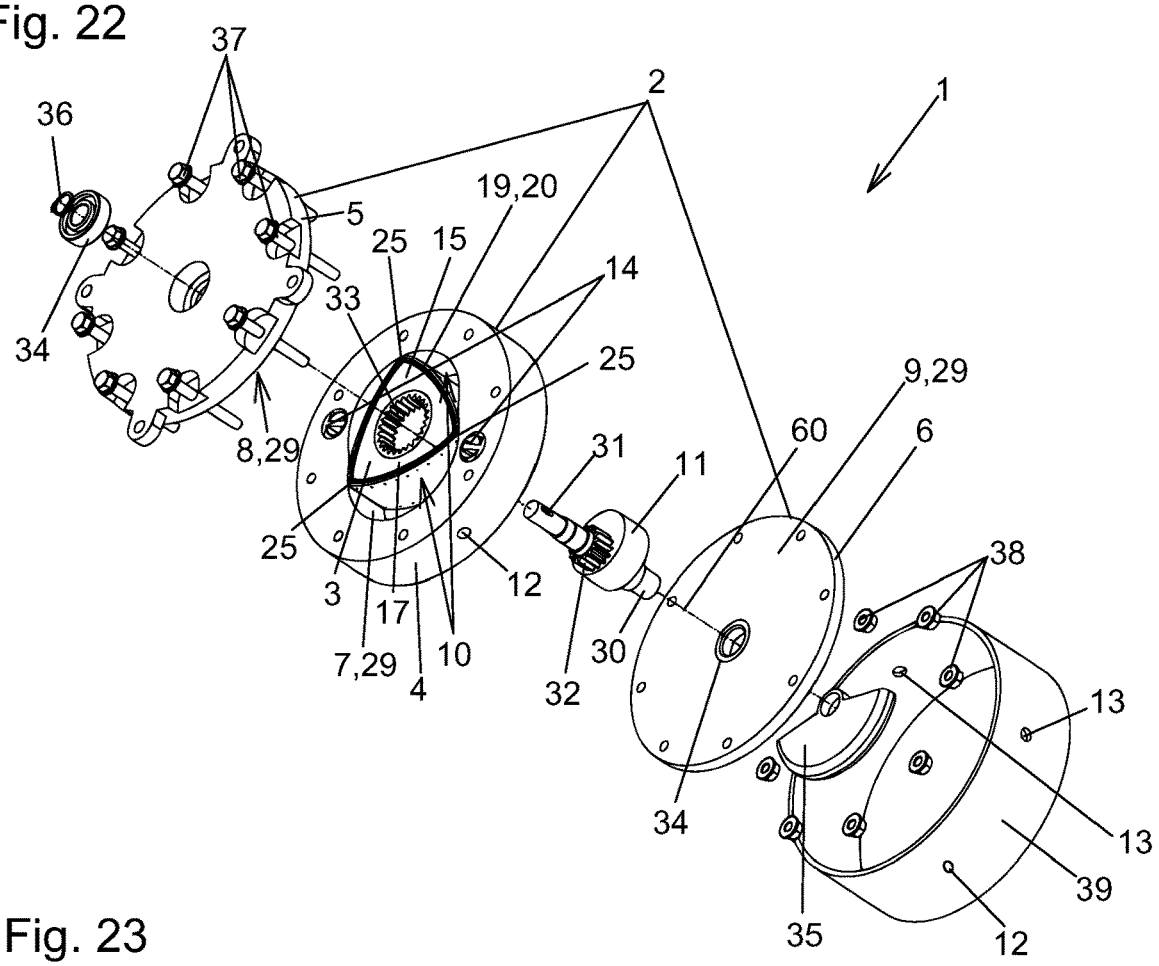
FIGS. 22 and 23 show illustrations of a rotary piston compressor according to the invention with a transmission ratio of 2:3.
Figure 23:
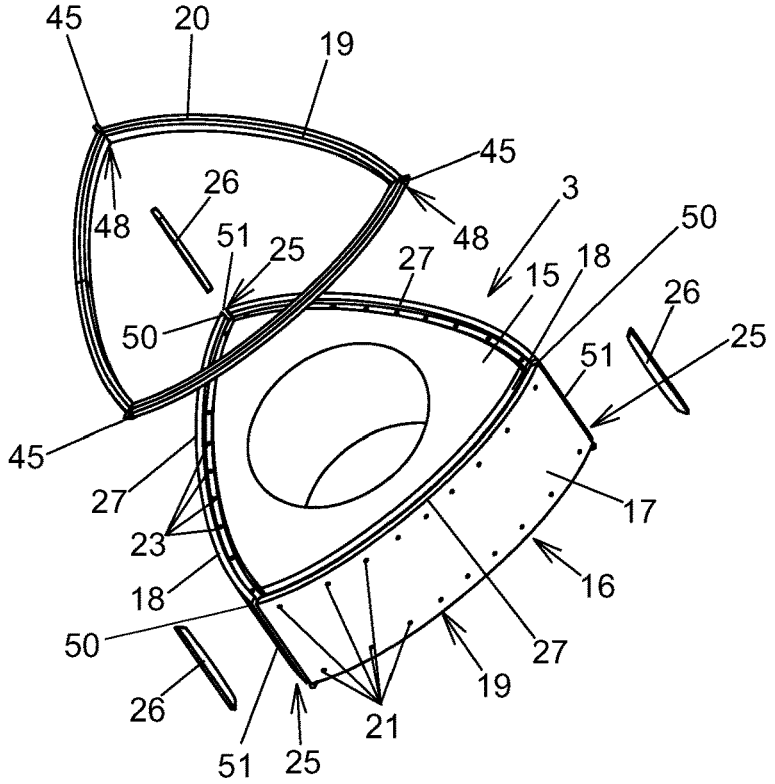

FIGS. 22 and 23 show, in turn in an exploded illustration, a second exemplary embodiment according to the invention of a rotary piston compressor 1, which is broadly similar to the first exemplary embodiment, and therefore here only the differences will be explained. The essential difference is that here a transmission ratio of 2:3 was realized. Accordingly, the rotary piston 3 of this exemplary embodiment also has three corner regions 25. The number of gas inlets 12 and gas outlets 13 and of the pressure-relief outlet valves 14 is correspondingly adapted, as is the shape of the side wall face 7 and the shape of the planar seal 19. In all other respects, however, what was said above applies in a form adapted to the necessary extent, and therefore further statements in this respect are omitted. It should be noted only that the internal toothing 33 illustrated in FIG. 22 was also not illustrated in FIG. 23. In this exemplary embodiment, in any case, it is also the case that the boundary lines 27 of the piston bases 15 and 16 that extend between the corner regions 25 also have the form of an envelope of an array of trochoid curves. The side face 7 of the housing wall 4 also has a completely trochoidal form here, as viewed in a sectional plane parallel to the planar sealing faces 8 and 9 of the housing covers 5 and 6. The arrangement according to the invention of the lateral-surface openings 21 and the pressure leadthrough lines 22 in the rotary piston 3 corresponds to the first exemplary embodiment and does not need to be explained again.

FIGS. 24 to 39 show a third exemplary embodiment of a rotary piston compressor 1 according to the invention. Here, it is a variant with a transmission ratio of 7:6. The rotary piston 3 of this rotary piston compressor 1 therefore has six corner regions 25. The regions of the piston lateral surface 27 that are between the corner regions 25 are in turn configured such that the boundary lines 27 delimiting the piston bases 15 and 16 each have the form of an envelope of an array of trochoid curves. The side wall face 7 of the housing side wall 4 has trochoid arcs, as viewed in a sectional plane 7 parallel to the planar sealing faces 8 and 9 of the housing covers 5 and 6.

By contrast to the previously explained exemplary embodiments of rotary piston compressors 1 according to the invention, in this exemplary embodiment it is provided that the eccentric 11 on which the rotary piston 3 is rotatably mounted in the working chamber 10 is not rotated like in the first two exemplary embodiments, but rather is arranged rigidly in the outer shell 39 of the rotary piston compressor 1. In this exemplary embodiment, the rotary piston 3 is rotated together with the working housing 2 and thus together with the housing side wall 4 and the two housing covers 5 and 6 about an axis of rotation 60 extending through the eccentric 11, while the eccentric 11 remains stationary. In order to achieve this, the rotary piston compressor 1 of this third exemplary embodiment has a rotor 52, which is connected by means of screws 37 and nuts 38 to the working housing 2 for conjoint rotation and interacts with a stator 54 rigidly connected to the outer shell 39 of the rotary piston compressor 1. The rotor 53 and the stator 54 form a drive motor, which rotates the working housing 2 with the rotary piston 3 mounted on the eccentric 11 in the working chamber 10 of the working housing 2.

A further difference of the third exemplary embodiment in relation to the two previously explained exemplary embodiments is that the gas inlet 12 and the gas outlet 13 in this third exemplary embodiment pass through the eccentric 11, and not through the housing wall 4 as in the first-explained exemplary embodiments. Correspondingly, flow transfer openings 55 that pass through the piston lateral surface 17 are also provided in the rotary piston 3. The gas can enter the corresponding portions of the working chamber 10 from the gas inlet 12 through these flow transfer openings 55 and from there also be conveyed back out again through the gas outlet 13 in compressed form.

In this third exemplary embodiment, the gas inlets 12 and gas outlets 13 that pass through the eccentric 11 open out into a valve cover 52, which sits on the outside of the outer shell 39 of the rotary piston compressor 1 and guides both the gas inlet 12 and the gas outlet 13 into or out of the rotary piston compressor.

Apart from the differences explained up to now and those yet to be explained below, reference can substantially be made to the description of the first exemplary embodiments. This applies in particular to the type of pressure application according to the invention, the planar seals 19 arranged in the planar-seal receiving channels 18 of the piston bases 15 and 16, for pressing their seal surfaces 20 against the planar sealing faces 8 and 9 of the housing covers 5 and 6.

Figure 24:
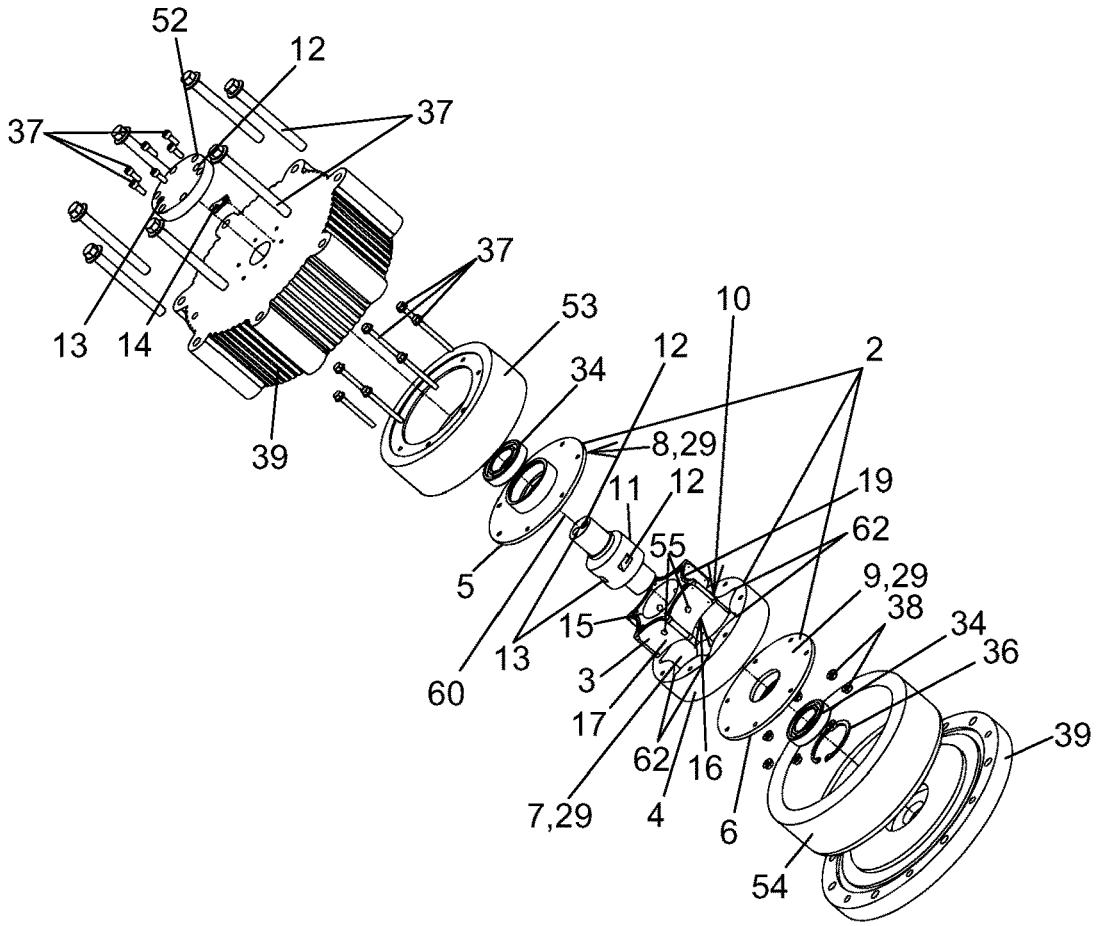
FIGS. 24 to 39 show illustrations relating to a rotary piston compressor according to the invention with a transmission ratio of 7:6.
Figure 25:
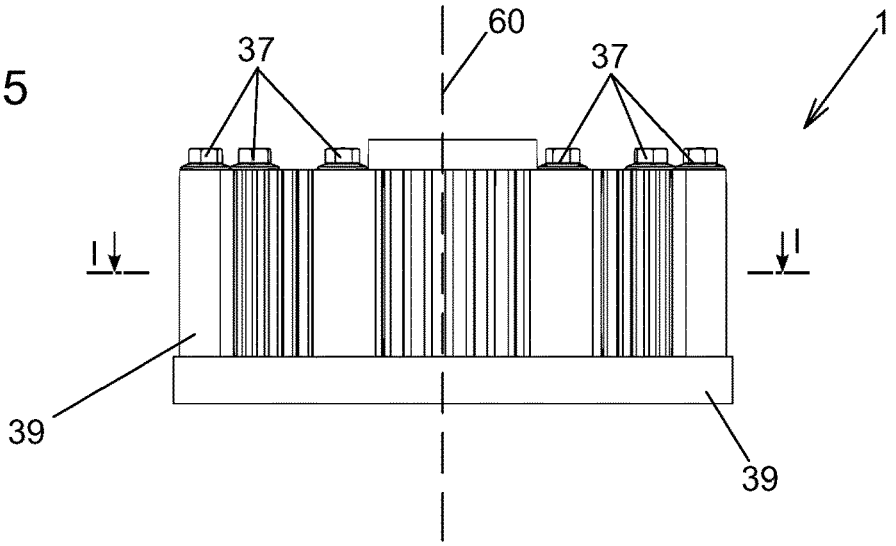
Figure 26:
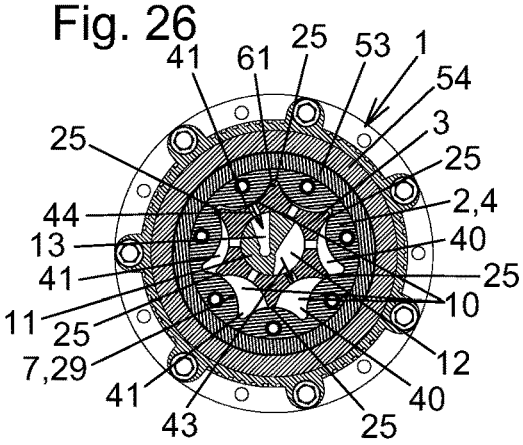
Figure 27:
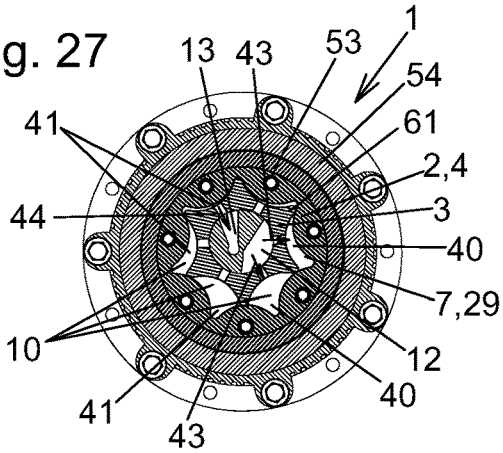
Figure 28:
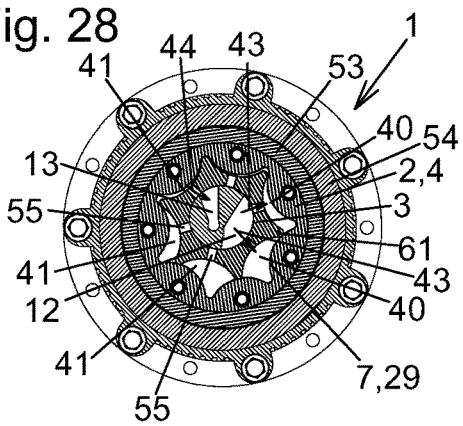
Figure 29:
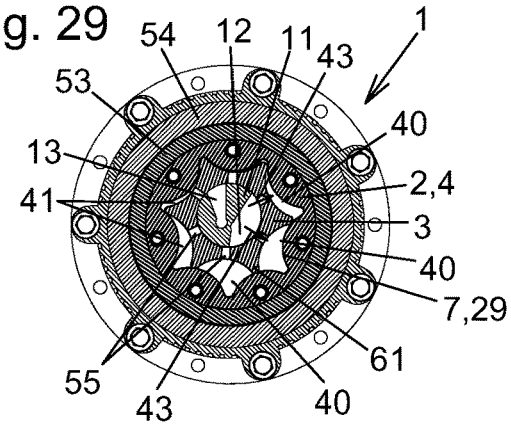
Figure 30:
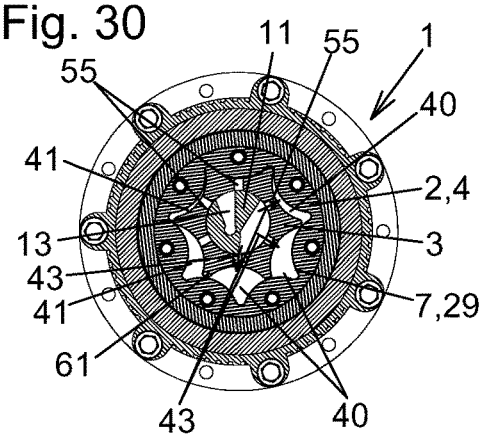
Figure 31:
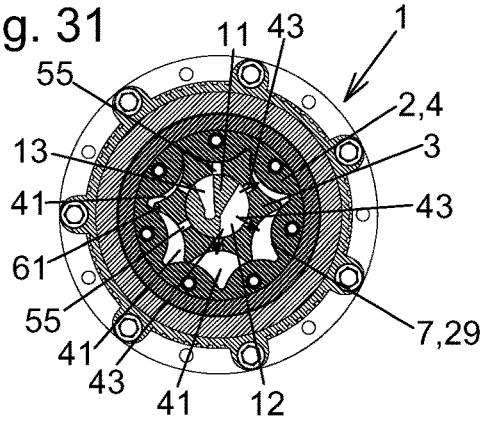
Figure 32:
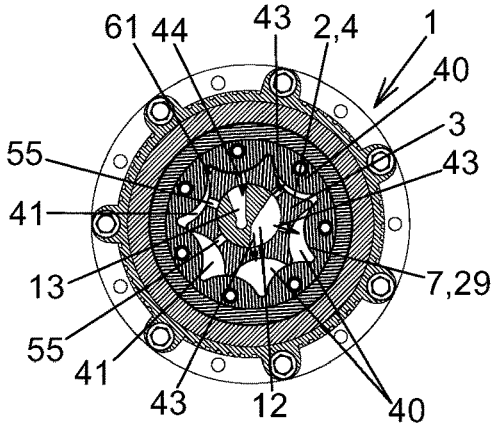

FIG. 25 shows the rotary piston compressor 1, illustrated in an exploded illustration in FIG. 24, of the third exemplary embodiment in a side view. FIG. 25 depicts the sectional plane II. FIGS. 26 to 32 each show sections in the sectional plane II relating to different current positions during operation of the rotary piston compressor 1 and thus during the rotation of the working housing 2 including the rotary piston 3 about the corresponding axis of rotation 60, which extends through the eccentric 11 and is depicted in FIGS. 24 and 25. In order to be able to better understand the rotary movement of the rotary piston 3 and the working housing 2 in FIGS. 26 to 32, a point 61 is depicted on the rotary piston 3 in FIGS. 26 to 32. This is only an illustrative aid which can be used to better understand the current position of the rotary piston 3 in the various illustrations according to FIGS. 26 to 32.

FIGS. 26 to 32 thus depict various intermediate stations during one revolution of the working housing 2 and the rotary piston 3 about the axis of rotation 60. The gas inlet 12 and the gas outlet 13 can be clearly seen in the eccentric 11. The arrows 43 each depict the gas which is yet to be compressed and flows into the respective subregions, currently acting as low-pressure side 40, of the working chamber 10 through the gas inlet 12 and the corresponding flow transfer openings 55. The arrows 44 depict the already compressed gas that is forced into each gas outlet 13 from the corresponding high-pressure side 41 of the working chamber 10. Following the position of the rotary piston 3 through FIGS. 26 to 32, it can be seen that the sub-volumes of the working chamber 10 that are denoted the low-pressure side 40 in the respective illustration are connected to the gas inlet 12 via the corresponding flow transfer openings 55 in the rotary piston 3, so that gas can flow in. In the sub-volumes of the working chamber 10 that are denoted the high-pressure side 41 in each case and in which there is no longer a connection to the gas inlet 12, the gas is then compressed by a corresponding relative movement between the rotary piston 3 and the working housing 2, in order then to be able to flow into the gas inlet 13 in compressed form, when the corresponding sub-volumes of the working chamber 10 are connected to the gas outlet 13 via the corresponding flow transfer opening 55 in the rotary piston 3.

Figure 33:
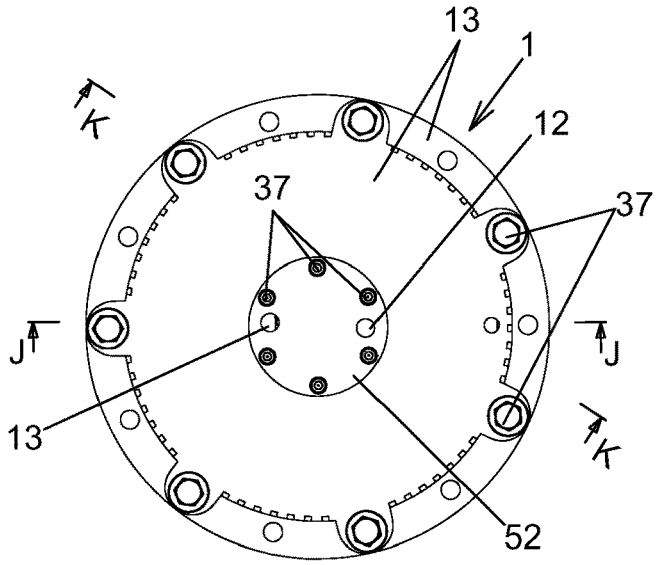
Figure 34:
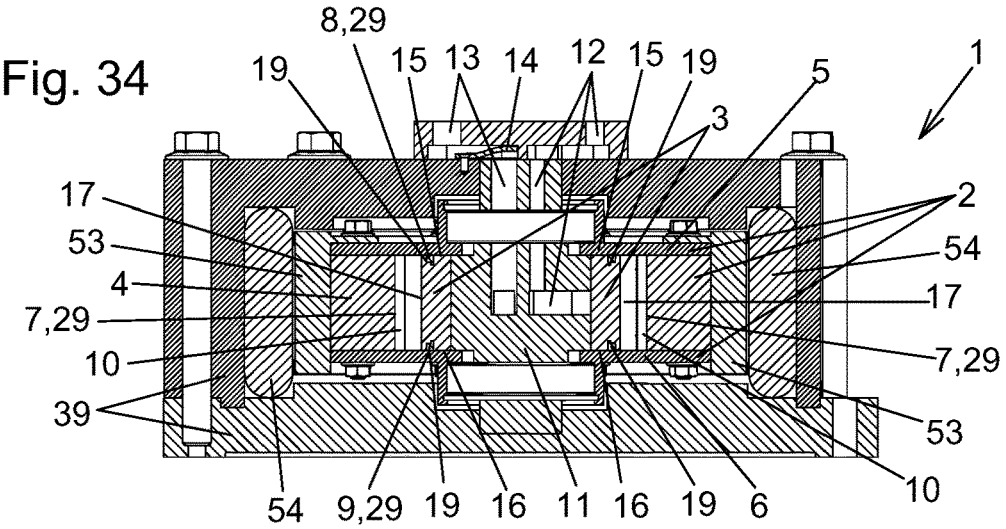

FIG. 33 shows a plan view of the third exemplary embodiment of the rotary piston compressor 1 according to the invention. FIG. 33 also depicts the sectional planes JJ and KK. FIG. 34 shows the section in the sectional plane JJ. What can be clearly seen in this FIG. 34 is how the gas inlet 12 passes through the valve cover 52 and the eccentric 11. What can be similarly clearly seen is how the gas outlet 13 likewise passes through the eccentric 11 and the valve cover 52. The pressure-relief outlet valve 14 provided in the gas outlet 13 in the region of the valve cover 52 is also illustrated. This is a spring-loaded closure which opens when the compressed gas coming from the working chamber 10 or from a high-pressure side 41 is at the desired pressure predefinable by the corresponding design of the pressure-relief outlet valve 14.

In the section according to FIG. 34, it is also possible to see the planar seals 19, which are arranged in the piston bases 15 and 16 in the corresponding planar-seal receiving channels 18 and correspondingly sealingly bear by way of their seal surfaces 20 against the planar sealing faces 8 and 9, respectively, of the housing covers 5 and 6.

Figure 35:
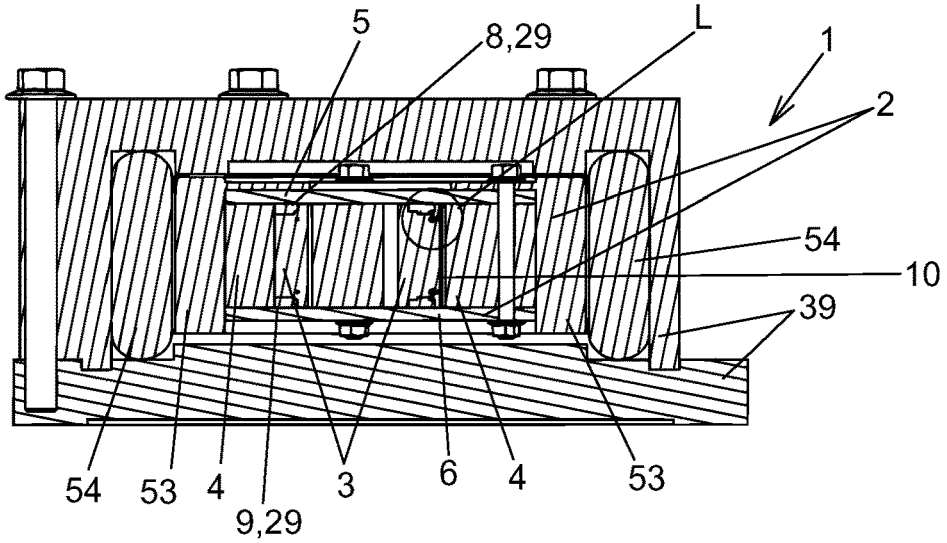
Figure 36:
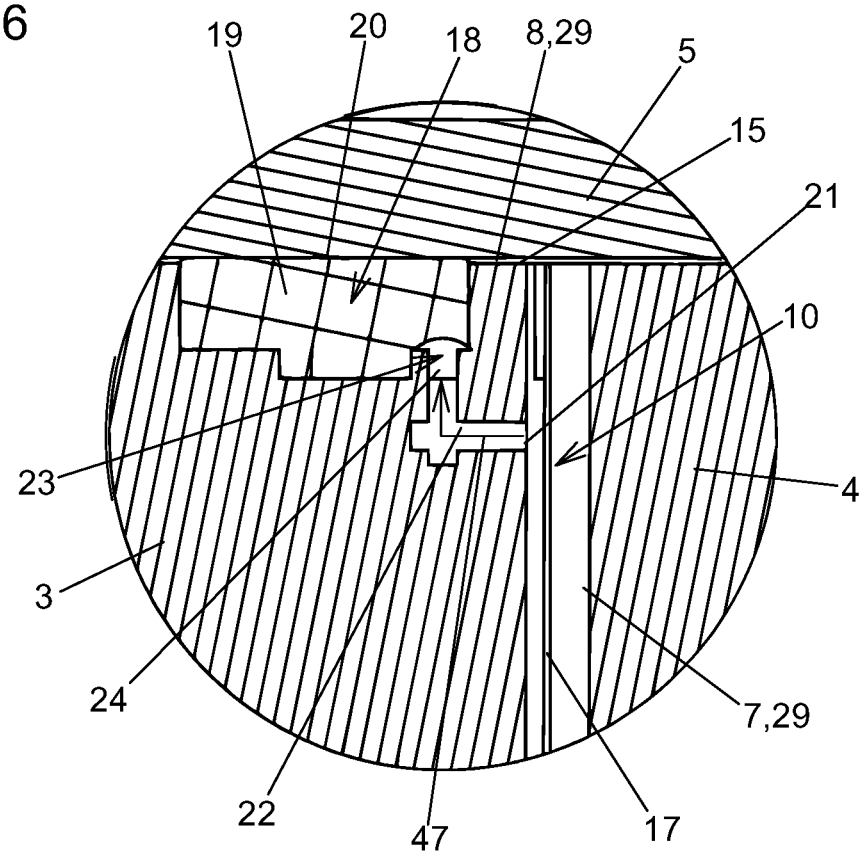

FIG. 35 shows the section along the sectional plane KK from FIG. 33. This is a sectional plane in which the lateral-surface openings 21 and pressure leadthrough lines 22 according to the invention are arranged. The corresponding detail L from FIG. 35 is illustrated as an enlargement in FIG. 36. Here, it can clearly be seen that it is also the case in this exemplary embodiment that, to press the seal surface 20 of the respective planar seal 19 against the respective planar sealing face 8 and 9, respectively, in the piston lateral surface 17 of the rotary piston 3 there are formed lateral-surface openings 21, which have a pressure-transmitting connection to the planar-seal receiving channel 18 via pressure leadthrough lines 22, which are formed inside the rotary piston 3 and each open into the respective planar-seal receiving channel 18 on a side of the respective planar seal 19 that faces away from the seal surface 20. FIG. 36 in turn uses the arrow 47 to depict the direction in which pressure is applied to the planar seal 19 on its side facing away from the seal surface 20. Like in the two first exemplary embodiments, it is thus also possible in this third exemplary embodiment for the pressurized gas present in the working chamber 10 to act on that side of the planar seal 19 that is opposite the seal surface 20 via the lateral-surface opening 21 and the pressure leadthrough line 22 that passes through the rotary piston 3, in order to press the seal surface 20 of the planar seal 19 against the corresponding planar sealing face 8 and 9 of the corresponding housing cover 5 and 6, respectively.

FIG. 36 also depicts the cap 24, the function of which was already explained above. This cap 24 can of course also be omitted here.

Figure 37:
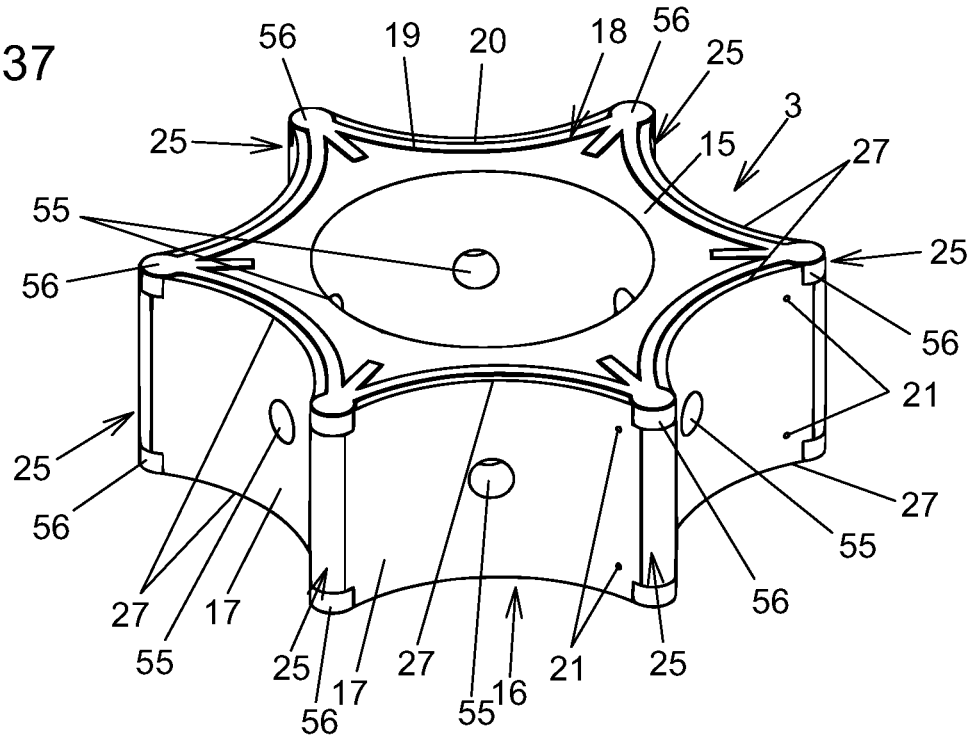
Figure 38:
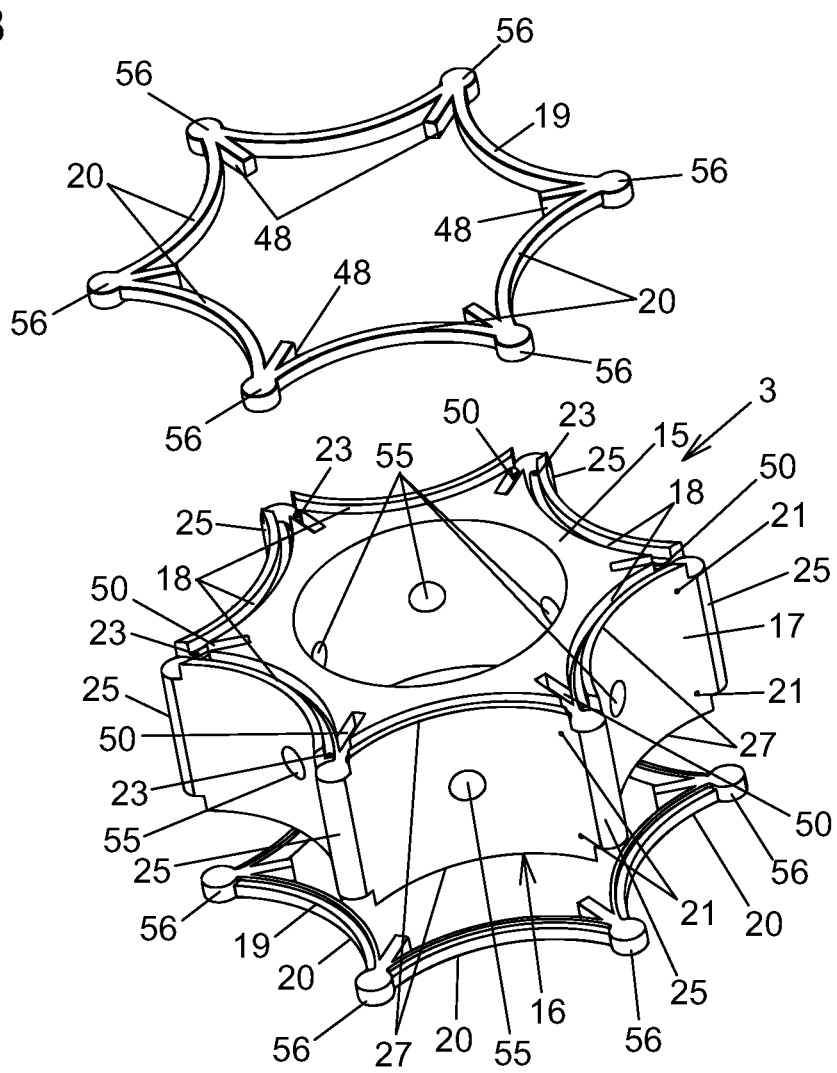

FIG. 37 shows a perspective illustration of the rotary piston 3 of this exemplary embodiment of the rotary piston compressor 1. What can be clearly seen in this perspective illustration is how the planar-seal receiving channel 18 is formed in the piston base 15 and the planar seal 19 is arranged therein. Also clearly visible are the flow transfer openings 55 and the lateral-surface openings 21 arranged in the piston lateral surface 17. FIG. 38 shows an exploded illustration of this, in which the planar seal 19 has been removed from the respective planar-seal receiving channel 18 of the respective piston base 15 and 16. Therefore, in FIG. 38 it is also possible to see the openings 23 in the planar-seal receiving channel 18, which are connected to the corresponding lateral-surface openings 21 via the corresponding pressure leadthrough lines 22.

The inwardly pointing sealing projections 48 that are integrally molded on the planar seals 19 are arranged in the corresponding sealing-projection receiving grooves 50 of the rotary piston 3 in the assembled state. They ensure, as is the case in the other exemplary embodiments, that the planar seals 19 are each sealed, with respect to the planar-seal receiving channel 18 that receives them, in the corner regions 25 of the rotary piston 3 on their side facing away from the respective seal surface 20.

Figure 39:
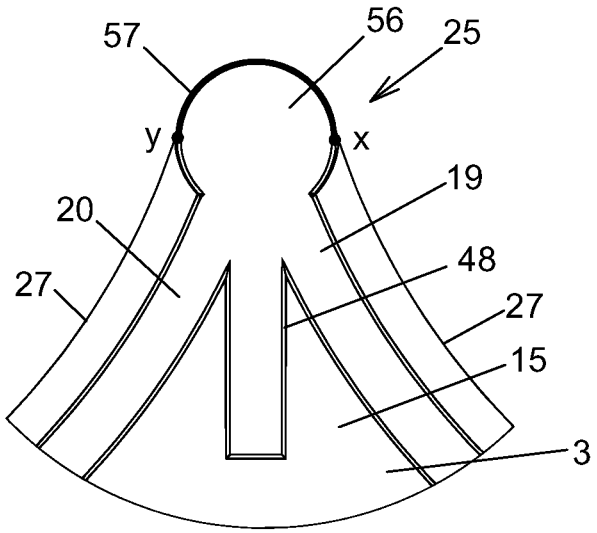

As can be seen particularly clearly in FIGS. 37, 38 and 39, the planar seals 19 of this exemplary embodiment each have seal corner regions 56 with correspondingly rounded contact faces 57. These rounded contact faces 57 provide sealing with respect to the corresponding rounded corner portions 62 of the side wall face 7 of the housing side wall 4, when the respective corner region 25 of the rotary piston 3 engages in the corresponding corner portion 62 of the housing side wall 4. The corner portions 62 are denoted as such in FIG. 24. When the respective seal corner region 56 rolls in the corner portion 62, the rounded contact face 57 of the seal corner region 56 always bears sealingly against the corresponding corner portion 62 and thus against the side wall face 7 at least at one point between the two end points X and Y illustrated in FIG. 39.

| List of Reference Signs: | |
|---|---|
| 1 | Rotary piston compressor |
| 2 | Working housing |
| 3 | Rotary piston |
| 4 | Housing side wall |
| 5 | Housing cover |
| 6 | Housing cover |
| 7 | Side wall face |
| 8 | Planar sealing face |
| 9 | Planar sealing face |
| 10 | Working chamber |
| 11 | Eccentric |
| 12 | Gas inlet |
| 13 | Gas outlet |
| 14 | Pressure-relief outlet valve |
| 15 | Piston base |
| 16 | Piston base |
| 17 | Piston lateral surface |
| 18 | Planar-seal receiving channel |
| 19 | Planar seal |
| 20 | Seal surface |
| 21 | Lateral-surface opening |
| 22 | Pressure leadthrough line |
| 23 | Opening |
| 24 | Cap |
| 25 | Corner region |
| 26 | Radial seal |
| 27 | Boundary line |
| 28 | Elastic element |
| 29 | Coating |
| 30 | Drive shaft |
| 31 | Connecting journal |
| 32 | External toothing |
| 33 | Internal toothing |
| 34 | Bearing |
| 35 | Balance weight |
| 36 | Securing ring |
| 37 | Screw |
| 38 | Nut |
| 39 | Outer shell |
| 40 | Low-pressure side |
| 41 | High-pressure side |
| 42 | Direction of rotation |
| 43 | Inflowing gas |
| 44 | Outflowing gas |
| 45 | Slanted face |
| 46 | Slanted face |
| 47 | Pressure application direction |
| 48 | Sealing projection |
| 49 | Radial seal surface |
| 50 | Sealing-projection receiving groove |
| 51 | Radial-seal receiving channel |
| 52 | Valve cover |
| 53 | Rotor |
| 54 | Stator |
| 55 | Flow transfer opening |
| 56 | Seal corner region |
| 57 | Contact face |
| 58 | Projection |
| 59 | Direction |
| 60 | Axis of rotation |
| 61 | Point |
| 62 | Corner portion |

The invention claimed is:

1. A rotary piston compressor for compressing gas, the rotary piston compressor comprising:

a working housing;

a rotary piston;

the working housing has a housing side wall and two housing covers arranged on oppositely situated sides of the housing side wall;

a side wall face of the housing side wall and a respective planar sealing face of the respective housing cover enclose a working chamber arranged in the working housing; and an eccentric on which the rotary piston is rotatably mounted in the working chamber;

a gas inlet for introducing the gas to be compressed into the working chamber;

a gas outlet with a pressure-relief outlet valve for discharging the compressed gas from the working chamber;

the rotary piston has two piston bases, which face toward a respective one of the planar sealing faces of the housing covers, and a piston lateral surface which faces toward the side wall face of the housing side wall;

a respective planar-seal receiving channel is formed in the piston bases;

a planar seal is arranged in each of the planar-seal receiving channels, the planar seals each have a seal surface for contacting one of the planar sealing faces of the housing covers;

wherein to press the seal surface of the respective planar seal against the respective planar sealing face, lateral-surface openings are formed in the piston lateral surface of the rotary piston, the lateral-surface openings have a pressure-transmitting connection to the respective planar-seal receiving channel via pressure leadthrough lines, which are formed inside the rotary piston and each open into the respective planar-seal receiving channel on a side of the respective planar seal that faces away from the seal surface; and wherein the rotary piston has two or more corner regions, and the planar seals are each sealed, with respect to the planar-seal receiving channel that receives them, in the corner regions of the rotary piston on a side thereof facing away from the respective seal surface.

2. The rotary piston compressor as claimed in claim 1, wherein the pressure leadthrough lines are at least one of: tubular, formed as a bore, or formed as a sequence of bores inside the rotary piston that lead into one another.

3. The rotary piston compressor as claimed in claim 1, wherein the lateral-surface openings are formed in the piston lateral surface at a distance from the piston bases.

4. The rotary piston compressor as claimed in claim 1, wherein the planar seals are each injected in the respective planar seal receiving channel as an injection molded part, or the planar seals are each printed in the respective planar-seal receiving channel as a 3D printed part, or in planar seals are each pressed in the respective planar-seal receiving channel as a molded pressed part.

5. The rotary piston compressor as claimed in claim 1, wherein the planar seals are each prefabricated as an insert part and inserted in the respective planar-seal receiving channel.

6. The rotary piston compressor as claimed in claim 1, wherein the pressure leadthrough lines are each covered by a cap in a region of a opening thereof into the respective planar-seal receiving channel.

7. The rotary piston compressor as claimed in claim 1, wherein the planar seals are intrinsically each formed in one piece in one of the planar-seal receiving channels in one of the piston bases.

8. The rotary piston compressor as claimed in claim 1, wherein the side wall face of the housing side wall has a completely or at least partially trochoidal form when viewed in a sectional plane parallel to the planar sealing faces of the housing covers.

9. The rotary piston compressor as claimed in claim 1, wherein the rotary piston has two or more corner regions.

10. The rotary piston compressor as claimed in claim 9, wherein the piston bases are each delimited by a boundary line in a region between two respective ones of the corner regions of the rotary piston, and the boundary lines are each in a form of an envelope of an array of trochoid curves.

11. The rotary piston compressor as claimed in claim 9, wherein a respective radial seal for sealing the rotary piston with respect to the side wall face of the housing side wall is arranged in the corner regions, and a respective elastic element, pointing toward the rotary piston, for pressing the respective radial seal against the side wall face of the housing side wall is integrally molded in one piece on the radial seals.

12. The rotary piston compressor as claimed in claim 11, wherein the planar seals each have contact faces for pressing the respective radial seal against the side wall face of the housing side wall.

13. The rotary piston compressor as claimed in claim 9, wherein the planar seals are each sealed, with respect to the planar-seal receiving channel that receives them, in the corner regions of the rotary piston on a side thereof facing away from the respective seal surface.

14. The rotary piston compressor as claimed in claim 1, wherein a respective radial seal for sealing the rotary piston with respect to the side wall face of the housing side wall is arranged in the corner regions.

15. The rotary piston compressor as claimed in claim 14, wherein the radial seals are formed of a polymer or a polymer comprising at least one of a dry lubricant or reinforcing fibers.

16. The rotary piston compressor as claimed in claim 1, wherein the planar seals are formed of a polymer or a polymer comprising at least one of a dry lubricant or reinforcing fibers.

17. The rotary piston compressor as claimed in claim 1, wherein the housing side wall and the housing cover each have a main body made of an aluminum alloy or a cast iron and a coating, which is applied to the main body to form the side wall face of the housing side wall and the planar sealing faces of the housing covers, and the coating is comprises a nickel-phosphorus layer or an aluminum-oxide layer or a dry-film lubricating layer or a combination of at least two of these layers.

* * * * *